US006978715B2

(12) United States Patent
Suda et al.

(10) Patent No.: US 6,978,715 B2
(45) Date of Patent: Dec. 27, 2005

(54) PRINTING PRESS, AND APPARATUS AND PROCESS FOR REGENERATING PRINTING PLATE

(75) Inventors: Yasuharu Suda, Hiroshima-ken (JP); Hideaki Sakurai, Hiroshima-ken (JP); Toyoaki Yasui, Hiroshima-ken (JP); Toyoshi Ohto, Hiroshima-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/393,397

(22) Filed: Mar. 21, 2003

(65) Prior Publication Data

US 2003/0213391 A1 Nov. 20, 2003

(30) Foreign Application Priority Data

Mar. 22, 2002 (JP) ..... 2002-081844
Mar. 25, 2002 (JP) ..... 2002-083559

(51) Int. Cl.[7] ..... B41C 1/10
(52) U.S. Cl. ..... 101/467; 101/457; 101/478
(58) Field of Search ..... 101/456–458, 101/462, 463.1, 465–467, 478, 425, 487; 430/302

(56) References Cited

U.S. PATENT DOCUMENTS

| | | | | |
|---|---|---|---|---|
| 6,318,264 | B1 | 11/2001 | D'Heureuse et al. | 101/467 |
| 2002/0000169 | A1 * | 1/2002 | Suda et al. | 101/463.1 |
| 2002/0001776 | A1 * | 1/2002 | Mori et al. | 430/302 |
| 2002/0017209 | A1 | 2/2002 | Gutfleisch et al. | 101/424 |
| 2002/0062755 | A1 * | 5/2002 | Suda et al. | 101/488 |
| 2002/0121206 | A1 * | 9/2002 | Ooishi | 101/450.1 |

FOREIGN PATENT DOCUMENTS

| | | | |
|---|---|---|---|
| EP | 0 903 223 | A1 | 3/1999 |
| EP | 1084863 | * | 3/2001 |
| EP | 1 160 082 | A2 | 12/2001 |
| JP | 63-102936 | | 5/1988 |
| JP | 10-250027 | | 9/1998 |
| JP | 11-105234 | | 4/1999 |

(Continued)

OTHER PUBLICATIONS

T. Minabe, et al.; "Study of Photo-Induced Hydrophilic Conversion on the $TiO_2$ Surfaces Involved by Structural Conformation Thereof", (Research Center for Advanced Science and Technology, The University of Tokyo. (Translation attached).

*Primary Examiner*—Stephen R. Funk
(74) *Attorney, Agent, or Firm*—Armstrong, Kratz, Quintos, Hanson & Brooks, LLP

(57) ABSTRACT

A printing press, and an apparatus and a process for regenerating a printing plate can repetitiously reuse the same printing plate and shorten time for decomposition of image areas formed by a hydrophobic organic compound under irradiation with activating light to delete the image areas. A process for regenerating a printing plate including a photosensitive layer, formed on the surface of a substrate, having a photocatalyst exhibits hydrophilicity responsive to activating light having energy higher than the photocatalyst's band-gap energy, and one or more hydrophobic image areas, formed on the surface of the photosensitive layer and operable to hold ink, comprises the steps of: removing ink remaining on the printing plate; hydrophilizing the surface of the printing plate by irradiating with the activating light and by heating the printing plate to delete the hydrophobic image areas; and applying an organic compound onto the printing plate.

13 Claims, 19 Drawing Sheets

FOREIGN PATENT DOCUMENTS

| | | | |
|---|---|---|---|
| JP | 11-147360 | | 6/1999 |
| JP | 11-197512 | | 7/1999 |
| JP | 11-254633 | | 9/1999 |
| JP | 2000-6360 | | 1/2000 |
| JP | 2000-062335 | * | 2/2000 |
| JP | 2001-205104 | | 7/2001 |
| JP | 2001-207082 | | 7/2001 |
| JP | 2002-1900 | | 1/2002 |

* cited by examiner

1:SUBSTRATE
2:INTERMEDIATE LAYER
3:PHOTOSENSITIVE LAYER
5:PRINTING PLATE
6:WATER

1:SUBSTRATE
2:INTERMEDIATE LAYER
3:PHOTOSENSITIVE LAYER
5:PRINTING PLATE
6:WATER

1:SUBSTRATE
2:INTERMEDIATE LAYER
3:PHOTOSENSITIVE LAYER
3a:PHOTOSENSITIVE LAYER (NON-IMAGE AREA)
3b:PHOTOSENSITIVE LATER (IMAGE AREA)

10:PRINTING PRESS
11:PLATE CYLINDER
12:PLATE CLEANING UNIT
13:IMAGING UNIT
14:ORGANIC COMPOUND APPLIER
15:HEATING DEVICE
16:LIGHT EMITTING DEVICE FOR HYDROPHILIZING (PRINT IMAGE DELETING UNIT)
17:INKING ROLLERS
18:FOUNTAIN SOLUTION FEEDER
19:BLANKET CYLINDER
20:PAPER

1:SUBSTRATE
2:INTERMEDIATE LAYER
3:PHOTOSENSITIVE LAYER
6:WATER
34:MELTED THERMOPLASTIC RESIN LAYER
35:PRINTING PLATE

1:SUBSTRATE
2:INTERMEDIATE LAYER
3:PHOTOSENSITIVE LAYER
6:WATER
35:PRINTING PLATE

1:SUBSTRATE
2:INTERMEDIATE LAYER
3:PHOTOSENSITIVE LAYER
3a:PHOTOSENSITIVE LAYER (NON-IMAGE AREA)
34:MELTED THERMOPLASTIC RESIN LAYER(IMAGE AREA)

10:PRINTING PRESS
11:PLATE CYLINDER
12:PLATE CLEANING UNIT
13:IMAGING UNIT
14:ORGANIC COMPOUND APPLIER
15:HEATING DEVICE
16:ACTIVATING LIGHT EMITTING UNIT
17:INKING ROLLERS
18:FOUNTAIN SOLUTION FEEDER
19:BLANKET CYLINDER
20:PAPER
21:WATER FEEDER

PRINTING PRESS, AND APPARATUS AND PROCESS FOR REGENERATING PRINTING PLATE

BACKGROUND OF THE INVENTION

1. Field of the Invention

The present invention relates to technology for regenerating a printing plate, for future reuse, including a photosensitive layer which has a photocatalyst and on which an image forming material of an organic compound or the like is applied. More particularly, the present invention relates to a printing press, and an apparatus and a process for regenerating a printing plate which employs the above technology.

2. Description of the Related Art

In recent years, digitalization of printing process has become progressing in the art. This technology involves creation of images and manuscripts in digitized form on a personal computer or reading images on a scanner and directly makes a printing plate based on the digital data thus obtained. This makes it possible to save labor in the printing processes and also to conduct high-precision printing with ease.

So-called PS plates (presensitized plates) have been commonly used as printing plate to date. A PS plate includes a hydrophilic non-image area made of anodized aluminum and has one or more hydrophobic image areas formed by curing a photosensitive resin on the surface of the anodized aluminum. Making of a printing plate with such a PS plate requires plural steps and hence, is time-consuming and costly. It is, therefore, difficult to reduce the time and the cost required for printing processes. Especially in short-run printing, the requirement for numerous steps causes increased printing costs. Additionally, since use of a PS plate requires a development step using an alkaline developer, serious problems arise not only with the need for considerable amounts of labor but also with environmental pollution caused by treatment of developer waste.

Further, it is a common practice to expose a PS plate whose surface is in contact with a film, through which a desired image is perforated, to light. This causes problems in making the printing plate directly from digital data and in promoting digitized printing processes. Moreover, after completion of printing of a pattern, it is necessary to replace the printing plate with another one in order to conduct printing of the following pattern, and used printing plates are thrown away.

To solve the above-described problems of PS plates, processes have been proposed to meet the digitization of printing processes while making it possible to omit the development step, and some of such processes have come into commercial use. For example, Japanese Patent Application Laid-Open (KOKAI) Publication No. SHO 63-102936 discloses a process of making a plate which comprises the steps of: applying ink containing a photosensitive resin, as an ink for a liquid ink-jet printer, onto the surface of a printing plate; and curing an image area by irradiation with light. Japanese Patent Application Laid-Open (KOKAI) Publication No. HEI 11-254633, on the other hand, discloses a process for making a color offset printing plate by an ink-jet head through which solid ink is jetted.

Also included in known processes are a process for making a printing plate, which comprises the step of wirting with a laser beam an image on a printing plate, which is made of a PET (polyethylene terephthalate) film on which a laser absorbing layer such as carbon black covered with a silicone resin layer is formed, to cause the laser absorbing layer to evolve heat, which ablates off the silicone resin layer; and another process for preparing a printing plate, which comprises the step of coating a linophilic laser absorbing layer on an aluminum plate, coating a hydrophilic layer on the laser absorbing layer, and then ablating off the hydrophilic layer with a laser beam as in the above-described process.

In addition, a process has also been proposed for the making of a printing plate made of a hydrophilic polymer by exposing the hydrophilic polymer imagewise such that the hydrophilic polymer is oleophilized.

Further, a process of directly forming an image on a PS plate with light is also proposed. For this purpose, an imaging unit utilizes a blue laser having a wavelength of 402 nm, and a so-called CTP (Computer To Plate) device including a micromirror and a UV (ultraviolet) lamp have been put on the market.

But, since each of the above-mentioned processes cannot continue to print a following pattern until a printing plate is replaced by another one subsequent to completion of printing of a pattern, they are not different from the conventional art in that the printing plate is thrown away after its one-time use even if it is possible to make printing plates directly from digital data.

On the other hand, a technique including regeneration of a printing plate has been disclosed. For example, Japanese Patent Application Laid-Open (KOKAI) Publication No. HEI 10-250027 refers to a latent image block copy making use of a titanium dioxide photocatalyst, a making process of the latent image block, and a printing press on which the latent image block is made. Japanese Patent Application Laid-Open (KOKAI) Publication No. HEI 11-147360 also discloses an offset printing process by a printing plate making use of a photocatalyst. Each of these disclosures writes an image using light (practically, ultraviolet light) to activate a photocatalyst and regenerate a printing plate by hydrophobization of the photocatalyst caused by heat treatment. Further, Japanese Patent Application Laid-Open (KOKAI) Publication No. HEI 11-105234 discloses a making process for a lithographic printing plate, which comprises the step of hydrophilizing a photocatalyst with activating light, i.e., ultraviolet rays, and then writing an image area by heat-mode recording.

As disclosed in the paper (pages 124–125) entitled "Study on Behavior of Photoinduced Hydrophilization Associated with Structural Change in Titanium Deoxide Surface", (by Sanbe et al.) distributed at the Fifth Symposium on "Recent Developments of Photocatalytic Reactions" of the Photo Functionalized Materials Society in 1998, Prof. Fujishima, Prof. Hashimoto, et al. of the Research Center for Advanced Science and Technology, The University of Tokyo, have confirmed hydrophilization of a titanium dioxide photocatalyst by heat treatment. According to the description in the above paper, the processes disclosed in the laid-open patent applications referred to in the above, that is, the processes each of which hydrophobizes a photocatalyst by heat treatment to regenerate a printing plate cannot regenerate to reuse a printing plate or make a printing plate.

With the foregoing problems in view, Inventors have been enthusiastically researching to develop a printing plate, on which an image is rapidly formed with an imaging unit utilizing the activating light or light (i.e., inactivating light) having a wavelength longer than that of the activating light and which is rapidly regenerated after completion of printing, and a process for making and regenerating such a printing plate.

As a result of the research, Inventors have conceived a process for regenerating a printing plate by applying an organic compound that causes hydrophobization onto the surface of the printing plate. In this process, regeneration largely depends on the speed of decomposition of the organic compound by the photocatalyst under irradiation with the activating light.

Japanese Patent Application Laid-Open (KOKAI) Publication No. 2000-6360 discloses a method to delete an image formed on a printing plate by irradiating a layer including a photocatalyst of the printing plate with activating light mainly including ultraviolet light.

Another Japanese Patent Application Laid-Open (KOKAI) Publication No. 2002-1900 states that, if a hydroplilic-and-oleophilic material applied on the surface shows photothermal effect, irradiation with heat rays such as infrared light deletes an image formed on the surface of a printing plate.

These processes however take a considerable time to delete an image formed on the printing plate.

SUMMARY OF THE INVENTION

With the foregoing problems in view, it is an object of the present invention to provide a printing press, a process and an apparatus for regenerating a printing plate in which a same printing plate can be repetitiously reused and at the same time an image formed by an organic compound on the surface of the printing plate can be deleted under irradiation with activating light in a shorter time.

As a first generic feature of the present invention, there is provided a process for regenerating, for future reuse, a printing plate including a photosensitive layer, formed on the surface of a substrate and having a photocatalyst that exhibits hydrophilicity responsive to activating light having energy higher than a band-gap energy of the photocatalyst, and one or more hydrophobic image areas, formed on the surface of the photosensitive layer and operable to hold ink, the process comprising the steps of: (a) removing ink remaining on the surface of the printing plate; (b) hydrophilizing the entire surface of the printing plate by irradiating the surface of the printing plate, from which ink has been removed in the step (a) of removing ink, with the activating light and by heating the surface of the printing plate to thereby delete the hydrophobic image areas formed on the surface of the printing plate; and (c) applying an organic compound onto the surface of the printing plate from which the hydrophobic image areas have been deleted in the step (b) of hydrophilizing.

With this process, it is possible to repetitiously reuse the same printing plate, thereby reducing the amount of waste discarded after print the print job and also printing plate costs. Additionally, heating of the surface of the printing plate under irradiation with the activating light decomposes the organic compound by the photocatalyst so that the image areas formed on the printing plate can be deleted in a short time. Regeneration of the printing plate therefore can be accomplished in reduced time.

As a second generic feature of the present invention, there is provided a process for regenerating, for future reuse, a printing plate including a photosensitive layer, formed on the surface of a substrate and having a photocatalyst that exhibits hydrophilicity responsive to activating light having energy higher than a band-gap energy of the photocatalyst, and one or more hydrophobic image areas, formed on the surface of the photosensitive layer and operable to hold ink, the process comprising the steps of: (d) removing ink remaining on the surface of the printing plate; (e) irradiating the surface of the printing plate, from which ink has been removed in the step (d) of removing ink, with the activating light; after the step (e) of irradiating,(f) applying water onto the surface of the printing plate; and (g) irradiating the surface of the printing plate, to which the water has been applied, with the activating light.

With the step (f) of applying water, it is possible to perform further rapid hydrophilization of the printing plate from which the remaining ink has been removed whereupon time required for regeneration of the printing plate can be reduced.

More complete deletion of the formed image areas minimizes deterioration of and impurity accumulation on the printing plate to increase the number of times that the same printing plate can be used.

As a preferable feature, a process of regenerating a printing plate may further comprise the step of, after the step (g) of irradiating, applying an organic compound onto the surface of the printing plate in order to repetitiously reuse the same printing plate.

As another preferable feature, the step (g) of irradiating may be performed after the step (f) of applying water so that rapid and complete hydrophilization of the surface of the printing plate is ensured.

As an additional feature, the step (g) of irradiating and the step (f) of applying water may be performed in parallel whereupon further rapid hydrophilization of the surface of the printing plate can be performed.

As a further feature, the surface of the printing plate may be heated in the step (e) of irradiating. The heating rapidly decomposes the organic compound, thereby shortening the time required for regeneration of the printing plate.

As a still further preferable feature, a hydrogen peroxide aqueous solution may be applied, as a substitute for water, onto the surface of the printing plate in the step (f) of applying water. As a result, since the hydrogen peroxide aqueous solution promotes not only generation of hydroxy groups but also decomposition of the minute amount of the organic compound remaining on the surface of the printing plate so that the formed image can be further completely deleted.

As a still further preferable feature, the organic compound may have a property of decomposing under action of the photocatalyst caused by irradiation with the activating light and a property of hydrophobizing the surface of the printing plate by reacting and/or interacting with the surface of the printing plate. With these properties, one or more hydrophilic non-image areas can be formed by irradiating one or more portions corresponding to the one or more non-image areas with the activating light on the surface of the printing plate on which the organic compound has been applied. In other words, it is possible to form an image having the hydrophilic non-image areas and the hydrophobic image areas on the surface of the printing plate.

As a still further preferable feature, the organic compound may have a property of decomposing under action of the photocatalyst caused by irradiation with the activating light and a property of hydrophobizing the surface of the printing plate, after the organic compound is melted into a film form by heat, by reacting and/or interacting with the surface of the printing plate or by adhering to the surface of the printing plate. With these properties, after the organic compound is applied to the surface of the printing plate, heating one or more portions corresponding to the image areas melts the organic compound applied on the surface to adhere the compound onto the printing plate so that the hydrophobic image areas are formed and the organic compound applied on the portions where are not heated is removed to thereby form an image including the hydrophilic non-image areas and the hydrophobic image areas on the surface of the printing plate.

As a still further preferable feature, the surface of the printing plate may be heated to approximately 50° C. to 200° C. in order to enhance the rate of decomposition of the organic compound by the photocatalyst so that the time required to regenerate a printing plate can be shortened.

As a still further preferable feature, the heating of the surface of the printing plate maybe performed by blowing hot air. Similar to the above preferable feature, it is possible to enhance the rate of decomposition of the organic compound by the photocatalyst so that the time required to regenerate a printing plate can be shortened.

As a still further preferable feature, the heating of the surface of the printing plate may be performed by irradiating the surface of the printing plate with light. Similar to the above preferable feature, it is possible to promote the rate of decomposition of the organic compound by the photocatalyst so that the time required to regenerate a printing plate can be shortened.

As a still further preferable feature, the activating light may have a wavelength of 600 nm or shorter. With this activating light, an activity of the photocatalyst can appear.

As a still further preferable feature, the photocatalyst may be a titanium dioxide photocatalyst or a modified titanium dioxide photocatalyst.

As a third generic feature of the present invention, there is provided an apparatus for regenerating, for future reuse, a printing plate including a photosensitive layer, formed on the surface of a substrate and having a photocatalyst that exhibits hydrophilicity responsive to activating light having energy higher than a band-gap energy of the photocatalyst, and one or more hydrophobic image areas formed on the surface of the photosensitive layer and operable to hold ink, the apparatus comprising: a plate cleaning unit for removing remaining ink coating the surface of the printing plate; an activating light emitting unit for emitting the activating light for irradiating the surface of the printing plate; a heating device for heating the surface of the printing plate; and an organic compound applier for applying an organic compound onto the surface of the printing plate, the plate cleaning unit, the activating light emitting unit, the heater and the organic compound applier being disposed around a plate cylinder on which the printing plate is to be mounted, respectively.

This apparatus enables the printing plate to be repetitiously reused with a reduced amount of waste discarded after print job, thereby also reducing the cost for the printing plate. Additionally, the heating of the surface of the printing plate under irradiation with the activating light activates the photocatalyst to decompose the organic compound so that the image areas formed on the surface of the printing plate can be deleted in a shorter time. As a result, regeneration of the printing plate can be executed in a shorter time.

As a fourth generic feature of the present invention, there is provided an apparatus for regenerating, for future reuse, a printing plate including a photosensitive layer, formed on the surface of a substrate and having a photocatalyst that exhibits hydrophilicity responsive to activating light having energy higher than a band-gap energy of the photocatalyst, and one or more hydrophobic image areas, formed on the surface of the photosensitive layer and operable to hold ink, the apparatus comprising: a plate cleaning unit for removing remaining ink coating the surface of the printing plate; an activating light emitting unit for emitting the activating light for irradiating the surface of the printing plate; and a water feeder for applying water onto the surface of the printing plate, the plate cleaning unit, the activating light emitting unit, and the water feeder being disposed around a plate cylinder on which the printing plate is to be mounted, respectively. With this apparatus, it is possible to rapidly perform the deletion of the print image by decomposition of hydrophobic image and hydrophilization of the surface of the printing plate after removing the remaining ink on the surface of the printing plate whereupon the regeneration of the printing plate takes a shorter time.

In addition to the above advantage, more complete deletion of the image areas minimizes deterioration of and impurity accumulation on the printing plate to increase the number of times that the same printing plate can be reused.

As a preferable feature, an apparatus for regenerating a printing plate may further comprise an organic compound applier for applying an organic compound onto the surface of the printing plate, which applier enables the printing plate to be repetitiously reused.

As an additional preferable feature, an apparatus for regenerating a printing plate may further comprise a heating device for heating the surface of the printing plate. With this heating device, decomposition and removal of the organic compound on the surface of the printing plate are accomplished at a great rate whereupon the time required for regeneration of the printing plate can be reduced.

As another preferable feature, the water feeder may apply a hydrogen peroxide aqueous solution, as a substitute for water, onto the surface of the printing plate. Since a hydrogen peroxide aqueous solution activates not only the generation of hydroxy groups on the surface of the printing plate but also the decomposition of the minute amount of the organic compound remaining on the surface of the printing plate resulting from the oxidative activity of the hydrogen peroxide, it is possible to delete the image areas more completely.

As an additional preferable feature, the organic compound, which is applied onto the surface of the printing plate by the organic compound applier, may have a property of decomposing under action of the photocatalyst caused by irradiation with the activating light and a property of hydrophobizing the surface of the printing plate by reacting and/or interacting with the surface of the printing plate. With this organic compound having the above properties, since at least part of the surface of the printing plate is hydrophilized by irradiating the part with the activating light after application of the organic compound hydrophobized the entire surface of the printing plate, it is possible to form a print image that consists of hydrophilic non-image areas and hydrophobic image areas on the surface of the printing plate.

As a further preferable feature, the organic compound, which is applied onto the surface of the printing plate by the organic compound applier, may have a property of decomposing under action of the photocatalyst caused by irradiation with the activating light and a property of hydrophobizing the surface of the printing plate, after the organic compound is melted into a film form by heat, by reacting and/or interacting with the surface of the printing plate or by adhering on the surface of the printing plate. With these properties, the print image including hydrophilic non-image areas and one or more hydrophobic image areas can be formed on the surface of the printing plate by heating to melt at least part of the surface of the printing plate, to which the organic compound has been applied, and then to adhere the melted part on the surface of the printing plate and further by removing the organic compound applied onto one or more parts that have not been heated.

As a still further preferable feature, the activating light may have a wavelength of 600 nm or shorter, which is able to activate the photocatalyst included in the photosensitive layer.

As a still further preferable feature, the photocatalyst may be a titanium dioxide photocatalyst or a modified titanium dioxide photocatalyst.

As a fifth generic feature of the present invention, there is provided a printing press comprising: an apparatus for regenerating a printing plate with one or more above features; and an imaging unit for forming a print image on the surface of the printing plate.

It is therefore possible to repetitiously reuse the same printing plate, which is regenerated by the apparatus for regenerating a printing plate, by forming the image areas on the surface of the printing plate, thereby reducing amount of waste discarded after print job and also a cost for the printing plate.

Other objects and further features of the present invention will be apparent from the following detailed description when read in conjunction with the accompanying drawings.

DESCRIPTION OF THE PREFERRED EMBODIMENTS

Various preferred embodiments of the present invention will now be described with reference to the accompanying drawings.

Figure 1:
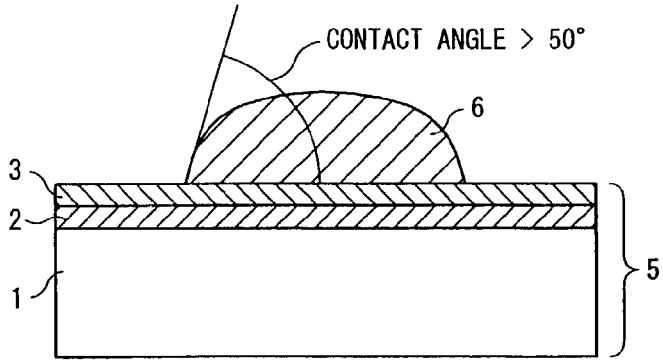
FIG. 1 is a sectional view illustrating the surface of a printing plate according to a first embodiment of the present invention, which plate exhibits hydrophobicity.
Figure 2:
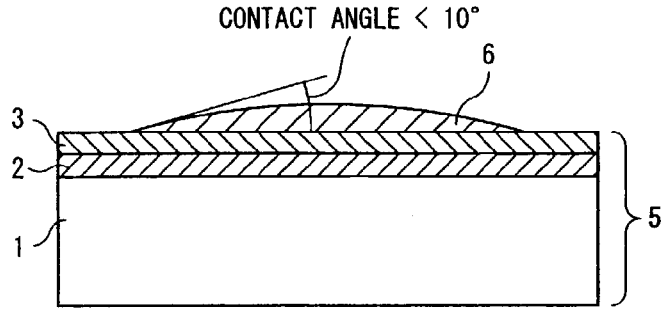
FIG. 2 is a sectional view illustrating the surface of the printing plate of the first embodiment exhibiting hydrophilicity.

(A) First Embodiment:

FIGS. 1 and 2 respectively illustrate a printing plate according to a first embodiment of the present invention: FIG. 1 is a sectional view of the surface of a printing plate exhibiting hydrophobicity; and FIG. 2, the surface of the printing plate exhibiting hydrophilicity.

As shown in FIG. 1, printing plate 5 basically includes substrate 1, intermediate layer 2 and photosensitive layer 3. Printing plate 5 is also simply called a "plate" and an image (hereinafter also called a print image) to be printed on paper 20 is formed on printing plate 5.

Substrate 1 is made of a sheet of a metal such as aluminum or stainless steel, a polymer film or the like. It is, however, to be noted that the material of the substrate 1 shall not be limited to the above examples.

Intermediate layer 2 is formed on substrate 1 to ensure adhesion of the substrate 1 to photosensitive layer 3 and to improve their adhesion. If sufficient adhesion strength is available between substrate 1 and photosensitive layer 3, the intermediate layer 2 may be omitted. Further, if substrate 1 is made of a polymer film or the like, the intermediate layer 2 may be formed for protection of the substrate 1 if necessary.

Intermediate layer 2 is, for example, made of a silicon compound such as silica ($SiO_2$) and silicone compound exemplified by silicone resin or silicone rubber. Especially, silicone alkyd, silicone urethane, silicone epoxy, silicone acrylic, silicone polyester or the like are used as silicone resin.

Intermediate layer 2 may be further formed by a substance capable of activating a photocatalyst included in photosensitive layer 3. For this purpose, intermediate layer 2 may include a semiconductor or an electric conductor.

For example, a preferable semiconductor included in intermediate layer 2 is an oxide semiconductor, such as zinc oxide ZnO, tin oxide $SnO_2$ or tungsten oxide $WO_3$. It is preferable that intermediate layer 2 is made of such a semiconductor. Alternatively, intermediate layer 2 may be formed by coating layer comprised of fine semiconductor particles and a binding compound (binder).

A preferable electric conductor included in intermediate layer 2 is an oxide such as ITO (an oxide of indium and tin), a metal such as aluminium, silver or copper, or carbon black, a conducting polymer. Intermediate layer 2 is made of such an electric semiconductor, or is formed by coating substrate 1 with fine particles of an electric semiconductor using a binding compound.

Intermediate layer 2 that includes a semiconductor or an electric conductor speeds up image formation by illumination of the activating light, so that it is possible to shorten time required to make a printing plate and to reduce light energy required to form the print image. Further, such an intermediate layer 2 can reduce an amount of energy of activating light with which the surface of printing plate 5 is irradiated in order to delete (cancel) a print image when regenerating the printing plate because it would appear that the semiconductor or the electric conductor included in intermediate layer 2 improves the function of a photocatalyst included in photosensitive layer 3, which is to be described later.

When carrying out heat treatment for the formation of photosensitive layer 3 to be described subsequently, intermediate layer 2 is also effective for preventing impurities included in the substrate 1 from thermodiffusing and from mixing into photosensitive layer 3, so that a reduction in photocatalytic activity is avoided.

Photosensitive layer 3 including a photocatalyst is formed on the surface of intermediate layer 2. If intermediate layer 2 is not formed on the surface of substrate 1, photosensitive layer 3 is formed directly on the surface of substrate 1.

Photosensitive layer 3 exhibits a high photocatalytic activity responsive to irradiation with activating light having energy higher than a band-gap energy of the photocatalyst included in photosensitive layer 3. This property is attributed to a property of the photocatalyst itself. FIG. 2 illustrates photosensitive layer 3 in a hydrophilized state being exposed by irradiation with activating light. Exposure of photosensitive layer 3 including a hydrophilic photocatalyst forms a non-image area on printing plate 5.

Printing plate 5 of the first embodiment is characterized by photosensitive layer 3 including a photocatalyst responsive to light having a wavelength of 600 nm for visible light or shorter (that is, the activating light is both visible light having a wavelength between 400 to 600 nm and ultraviolet light having a wavelength equal to or shorter than 400 nm). A photocatalyst included in photosensitive layer 3 causes photosensitive layer 3 to exhibit high hydrophilicity in response to irradiating of the surface of photosensitive layer 3 with the activating light having a wavelength up to 600 nm. Additionally, if the surface of photosensitive layer 3 is, for example, coated with an organic compound, the photocatalyst in photosensitive layer 3 decomposes the organic compound under irradiation with the activating light. The organic compound will be described in detail later.

A photocatalyst is not activated unless being irradiated with light having energy higher than the band-gap energy thereof. For example, since a titanium dioxide photocatalyst is as high as 3 eV in band-gap energy, the photocatalyst responds only to ultraviolet light having a wavelength up to 400 nm.

An energy level set between the band gaps allows the present invention to utilize a photocatalyst responsive also to activating light having a wavelength up to 600 nm, which light includes visible light having a wavelength longer than 400 nm. Activating light having a wavelength up to 600 nm of course includes ultraviolet light, although the activating light may not include ultraviolet light. Namely, the photocatalyst utilized in the present invention responds to activating light only constituted of visible light whose wavelength is between 400 through 600 nm.

Executing of methods that are already known produces a photocatalyst responsive to visible light. For example, Japanese Patent Laid-Open (KOKAI) Publication No. 2001-207082 discloses a titanium dioxide photocatalyst obtained by doping nitrogen atoms; Japanese Patent Laid-Open (KOKAI) Publication No. 2001-205104, a titanium dioxide photocatalyst obtained by doping chromium and nitrogen atoms; and further Japanese Patent Laid-Open (KOKAI) Publication No. HEI 11-197512, a titanium dioxide photocatalyst obtained by ion implantation using metal ions, such as chromium ions. A titanium dioxide photocatalyst is generated by another disclosed method in which cryogeneic plasma is utilized, and a titanium dioxide photocatalyst containing platinum is also disclosed. The photocatalyst of so-called visible-light responsive type, which is obtained by execution of one of the above disclosed methods, is used to prepare printing plate 5 of the present embodiment.

Conversely, a photocatalyst responsive to ultraviolet light having a wavelength up to 400 nm can be selected from ordinary titanium dioxide photocatalysts on the market.

The crystal structure of titanium dioxide photocatalyst is available in rutile, anatase and brucite. These structures are all usable in this embodiment, and they may be used in combination. The anatase structure is preferred, considering photocatalytic activity.

In order to improve the photocatalytic activity that decomposes an image area under irradiation with the activating light as will be described subsequently, a titanium dioxide photocatalyst small in particle diameter to a certain level is preferable. Specifically, the particle size of a titanium dioxide photocatalyst is 0.1 $\mu$m or smaller, with a particle diameter of not greater than 0.05 $\mu$m being more preferred. It is to be noted that the photocatalyst shall not be limited to the titanium dioxide photocatalyst, although the titanium dioxide photocatalyst is suitable.

Specific examples of titanium dioxide photocatalysts, which are available on the market and are usable in this embodiment, can include "ST-01" and "ST-21", their processed products "ST-K01" and "ST-K03", and water-dispersion types "STS-01", "STS-02" and "STS-21", all products of Ishihara Sangyo Kaisha, Ltd.; "SSP-25", "SSP-20", "SSP-M" and "CSB", "CSB-M", and coating formulation types, "LACTI-01" and "LACTI-03-A", all products of Sakai Chemical Industry Co., ltd.; Titanium dioxide coating formulations for photocatalyst "TKS-201", "TKS-202", "TKC-301", "TKC-302", "TKC-303", "TKC-304", "TKC-305", "TKC-351" and "TKC-352", and titanium dioxide sols for photocatalyst "TKS-201", "TKS-202", "TKS-203" and "TKS-251", all products of Tayca Corporation; and "PTA", "TO" and "TPX", all, products of ARITEC CORP. Additionally, a photocatalyst used in the present embodiment may be a modification of one of the above examples. Titanium dioxide photocatalysts other than those exemplified above can also be applied.

The thickness of photosensitive layer 3 is preferably in a range of from 0.005 to 1 μm, because an unduly small thickness makes it difficult to fully utilize the above-described properties while an excessively large thickness makes photosensitive layer 3 susceptible to cracks and causes a reduction in lifetime of plate. As this cracking is pronouncedly observed when the thickness exceeds 10 μm, it is necessary to consider this 10 μm as an upper limit even if one tries to enlarge this range of thickness. In practice, this thickness may preferably be set in a range of from 0.01 to 0.5 μm or so.

Photosensitive layer 3 is formed by a selected one of the sol coating processes, the organic titanate process, the vapor deposition process or the like. If the sol coating process is adopted, for example, a sol coating formulation employed for use in the sol coating process may contain a solvent, a crosslinking agent, a surfactant and the like in addition to at least one of the above-described substances for improving the strength of photosensitive layer 3 and its adhesion with substrate 1.

The coating formulation may be either a room temperature drying type or a heat drying type, with the latter being more preferred because, in order to provide the resultant printing plate 5 with improved lifetime, it is advantageous to promote the strength of photosensitive layer 3 by heating. It is also possible to form photosensitive layer 3 of high strength, for example, by causing a photocatalyst layer of amorphous titanium dioxide to grow on a metal substrate by a vapor deposition process and then crystallizing the amorphous titanium dioxide by heat treatment or by executing another method.

The organic compound to hydrophobize photosensitive layer 3 of course has a function of covering at least the hydrophilic portion of the surface of printing plate 5 as a consequence of an action or a strong interaction with the hydrophilic portion and then hydrophobizing the surface of photosensitive layer 3. In addition to the above property, a preferable organic compound is decomposed by oxidative decomposition function of a photocatalyst in response to irradiation with activating light.

The organic compounds operable to be used in the present invention are classified into two types in accordance with methods of forming image on printing plate 5.

The present first embodiment focuses on one of two image forming methods, which one uses one of the two types of organic compounds. The other forming method will be explained in the second embodiment.

The organic compounds (of type A) used in the present embodiment are applied to the surface of printing plate 5 and then hydrophobize the surface of photosensitive layer 3 through an action and/or a strong interaction with the surface of photosensitive layer 3 simply by being dried or, if necessary, heat-dried. Further, the organic compound of type A decomposes in response to the action of photocatalyst on photosensitive layer 3 under irradiation with activating light so that the compound is removed from the surface of photosensitive layer 3.

Preferable organic compounds of type A are an organic titanium compound, an organic silane compound, an isocyanate compound, and an epoxide compound. These organic compounds respectively react with a hydroxy group present at the surface of photosensitive layer 3 to be fixed to the surface. As a result, an organic compound monomolecular layer (non-illustrated) is formed on the surface of photosensitive layer 3 in principle. Hydrophobizing the surface of photosensitive layer 3 by the monomolecular layer decomposes the organic compound under irradiation with the activating light with ease.

The organic titanium compound is exemplified by (1) an alkoxy titanium, such as a tetra-i-propoxy titanium, a tetra-n-propoxy titanium, a tetra-n-butoxy titanium, a tetra-i-butoxy titanium or a tetrastearoxy titanium, (2) a titanium acylate, such as a tri-n-butoxy titanium stearate or an isopropoxy titanium tristearate, or (3) a titanium chelate, a diisopropoxy titanium bisacetylacetonate, a dihydroxy bislactato titanium or a titanium-i-propoxyoctylene grycol.

The organic silane compound is (1) an alokoxysilane exemplified by a trimethylnemethoxysilane, a trimethylethoxysilane, a dimethyldiethoxysilane, a methyltrimethoxysilane, a tetramethoxysilane, a methyltriethozysilane, a tetraethozysilane, a methyldimethoxysilane, an octadecyltrimethoxysilane or an octadecyltriethoxy ilane, (2) a chlorosilane, such as a trimethylchlorosilane, a dimethyldichlorosilane, a metyltrichlorosilane, a methyldichlorosilane, or a dimethylchlorosilane, (3) a silane coupler, such as a vinyltrichlorosilane, a vinyl-triethoxysilane, a .gamma.-chloropropyltri-methoxysilane, a .gamma.-chloropropyl methyldichlorosilane, a .gamma.-chloropropyl methyldimethoxysilane, a .gamma.-chloropropyl methyldiethoxysilane or .gamma.-aminopropylethoxysilane, or (4) a pholoroalkylsilane exemplified by a perpholoroalkyltrimethoxysilane.

The isocyanate compound is an isocyanicdodecyl, an isocyanic octadecyle or the like.

The epoxide compound is exemplified by a 1,2-epoxydecane, a 1,2-epoxyhexadecane, or a 1,2-epoxyoctadecane.

The origanic titanium compound, an organic silane compound, an isocyanate compound, and an epoxide compound should be by no means be limited to those examples described above.

The organic compound of type A is coated on photosensitive layer 3 by a method of either dip coating, roll coating, or blade coating if the compound is liquid at room temperature. Alternatively, photosensitive layer 3 may be coated with microdrops of the organic compound, which microdrops are formed by a spray. Further, photosensitive layer 3 may be coated with the organic compound in the form of gas obtained by heating the compound to a temperature below the decomposition temperature or vapor formed by a nebulizer utilizing ultrasound. Needless to say, the compound may be resolved in another solution in order to adjust its concentration and viscosity.

A succession of procedural steps of making and regenerating a printing plate according to the first embodiment will now be described.

Figure 4:
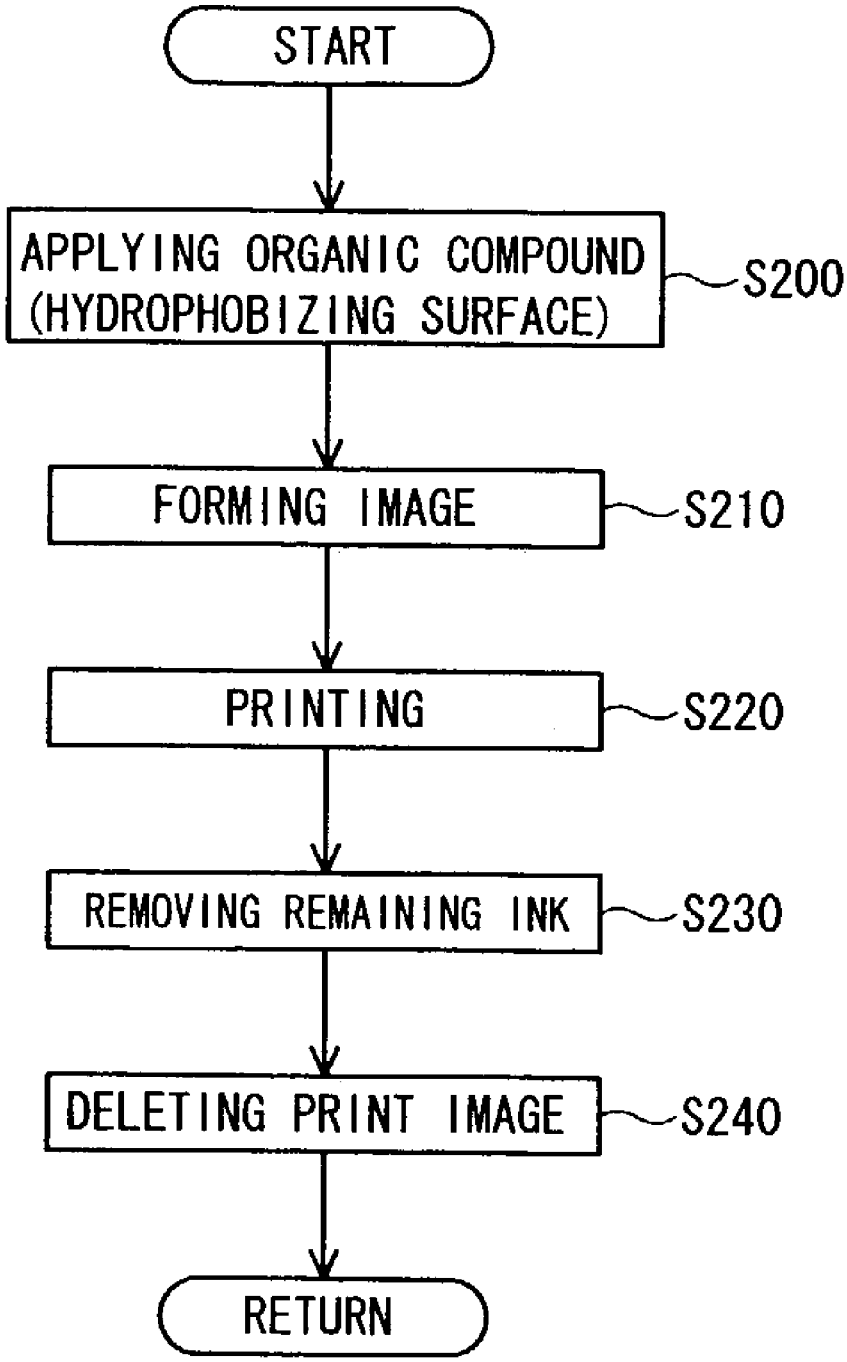
FIG. 4 is a flow diagram illustrating a succession of procedural steps of making and regenerating a printing plate according to the first embodiment.

As shown in FIG. 4, making and regenerating of printing plate 5 comprises the succession of procedural steps of applying the organic compound (hydrophobizing the surface) (S200), forming an image (S210), printing (S220), removing remaining ink (S230), and deleting the formed image (S240).

Procedural steps of making a printing plate will now be described.

Hereinafter, making of a printing plate means to form a hydrophilic non-image area by irradiating at least part of the surface of a printing plate 5 (i.e., the surface of photosensitive layer 3) in a hydrophobic state (the initial state) with the activating light on the basis of the digital data. Whereby, a combination of the hydrophilic non-image area and a hydrophobic image area, which is not irradiated with the activated light, forms a latent image on the surface of printing plate 5.

Figure 3:
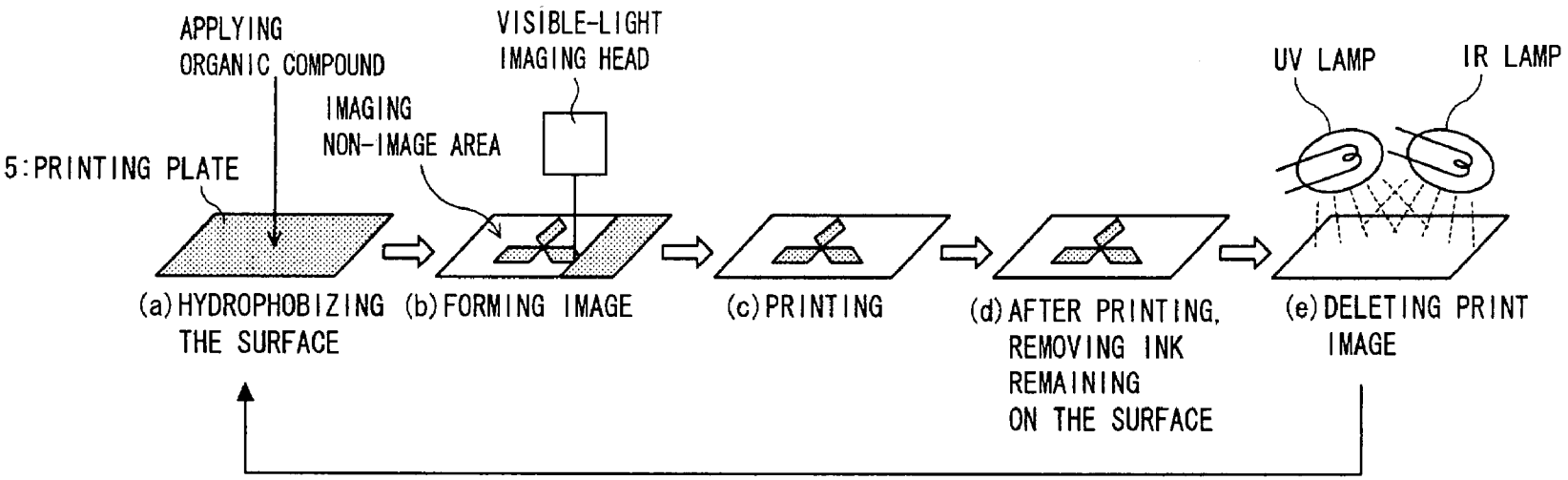
FIG. 3 is a perspective diagram illustrating a cycle of operations from image formation on a printing plate to regenerating the printing plate according to the first embodiment.

First of all, the organic compound is applied onto the surface of photosensitive layer 3, whose entire surface is hydrophilized in the prior cycle of the procedural step (of deleting of the formed image (S240)) in order to act and/or interact with the surface of photosensitive layer 3 so that the surface of photosensitive layer 3 is hydrophobized (the step (S200) of hydrophobizing the surface of printing plate 5), as shown in FIG. 3(*a*). Further, FIG. 3(*a*) illustrates the surface of photosensitive layer 3 onto which the organic compound is applied, i.e., printing plate 5 in the initial state, whose surface is hydrophobized. Here, the surface of printing plate 5 in a hydrophobic state has a contact angle of 50° or greater, preferably, 80° or greater against water 6, which is in such a state that hydrophobic printing ink is held with ease but the fountain solution is hardly deposited.

This state of the surface of the photosensitive layer 3 will be called the initial state in the making of the printing plate, which can be considered as the time of starting of the performing of printing (S220). More specifically, the initial state in the making of the printing plate can be considered to indicate a state wherein the digitized data representing a desired image have already been provided and are about to be formed onto printing plate 5.

Subsequently, the desired image is formed onto the hydrophobic surface of photosensitive layer 3 in the step (S210) of forming an image, as shown in FIG. 3(*b*).

The forming of the image is performed by writing (inscring) a non-imaged area (hereinafter also called imaging) onto photosensitive layer 3 in accordance with the digital data representing the desired image. The non-image area, as shown in FIG. 2, is hydrophilic and thereby has a contact angle up to 10° against water 6, which is in such a state that the fountain solution adheres easily but printing ink is hardly deposited.

In order to form a hydrophilic non-image area based on the digital data, photosensitive layer 3, having a photocatalyst which exhibits a catalytic activity responsive to irradiation with light having a wavelength of 600 nm or shorter, i.e., activating light, is partially irradiated with the activating light. The irradiation with the activating light causes photocatalysis to oxidatively decompose the organic compound, so that the organic compound is removed from one or more portions of the surface of photosensitive layer 3. At the same time, the irradiated portions on photosensitive layer 3 are hydrophilized.

Figure 5:
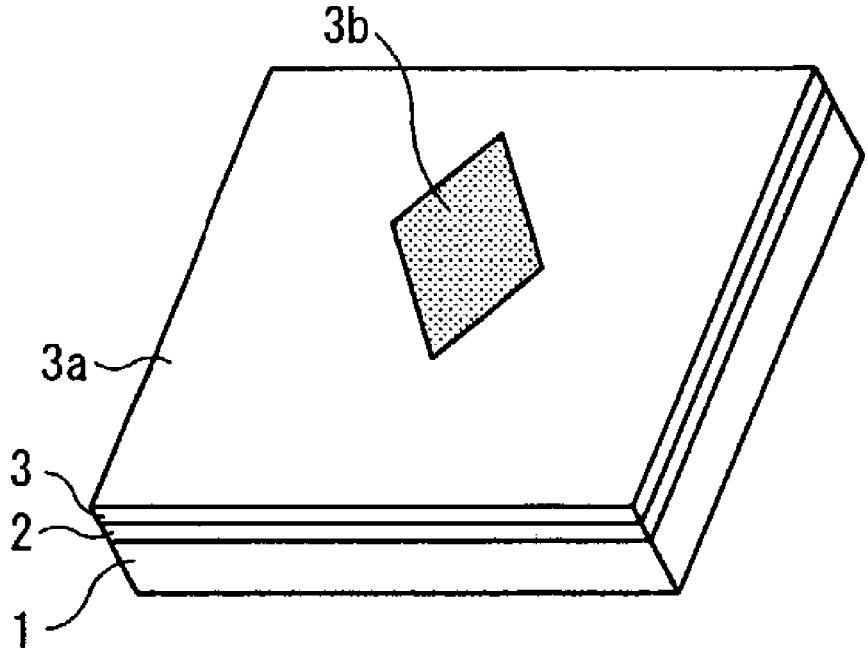
FIG. 5 is a perspective diagram schematically illustrating an example of a printing plate according to the first embodiment.

On the other hand, one or more portions of the surface of photosensitive layer 3, which portions are not irradiated with the activating light, remain hydrophobic so that the surface of printing plate 5 includes one or more hydrophobic and hydrophilic portions. In other words, for example, portion 3*a* irradiated with the activating light is regarded as a hydrophilic non-image area and portion 3*b* not irradiated with the activating light is regarded as a hydrophobic image area so that printing plate 5 is made, as illustrated in FIG. 5.

In FIG. 3(*b*), an imaging head utilizing visible light, for example, violet laser having a wavelength of 405 nm, writes non-image area 3*a* to thereby form non-image area 3*a* on the surface of photosensitive layer 3, which was in a hydrophobic state.

An alternative imaging head to form hydrophilic non-image area 3*a* in accordance with the digital image data other than the one utilizing violet laser having a wavelength of 405 nm may be any type and shape utilizing activating light to write an image exemplified by an imaging head equipped with a light source to emit light of wavelengths of 360 to 450 nm and a micro-mirror whose product name is the UV-SETTER™ 710 manufactured by basysPrint GmbH.

After completion of the step (S210) of forming an image, image and non-image areas are already formed on the surface of the photosensitive layer 3, as shown in FIG. 3(*c*) whereupon a desired image is ready to be printed in the subsequent step (S220) of printing.

At the step (S220) of printing, a so-called emulsion ink of a mixture of a hydrophobic printing ink and the fountain solution is applied onto the surface of printing plate 5.

As a result of applying emulsion ink onto the surface illustrated in FIG. 5: on the hatching portion (that is, hydrophobic image area} 3*b* holds the hydrophobic printing ink; and the remaining white portion (that is, hydrophilic non-image area} 3*a* preferentially holds the fountain solution while the hydrophobic ink is repelled so that the ink does not deposit on non-image area 3*a*. Photosensitive layer 3 on which an image (a printing pattern) emerges functions as printing plate 5. After that, the image is printed on paper 20 to accomplish the step of printing.

Printing plate regeneration processes will now be described.

Regeneration of the printing plate will hereinafter mean to cause the printing plate 5, whose surface partially exhibits hydrophobicity with the remaining part exhibiting, hydrophilicity, to be restored to the initial state in the making of the printing plate by evenly hydrophilizing the entire surface of photosensitive layer 3 and by applying the organic compound onto the photosensitive layer 3 to conduct a reaction and/or an interaction performed by photosensitive layer 3 and the organic compound so that the hydrophilic portion of photosensitive layer 3 (i.e., a surface property of the photocatalayst) changes to hydrophobic.

Evenly hydrophilizing the entire surface of printing plate 5, which is performed prior to hydrophobization of printing plate 5 aims to completely delete an image formed on printing plate 5.

First of all, the step (S230) of removing remaining ink is started by removing ink, the fountain solution, and a paper dust remaining on the surface of photosensitive layer 3, which has completed printing, as shown in FIG. 3(*d*). Removal of remaining ink is carried out by being transmitted onto paper after supply of an ink onto the surface of printing plate 5 is stopped, by wiping off using a reeling cloth tape, by wiping off using a roller around which a cleaning cloth is wrapped, by spraying cleaning solvent onto the surface of printing plate 5 for washing off, or the like.

After that, the entire surface of photosensitive layer 3 is irradiated with the activating light so that, in addition to non-image area 3*a*, image area 3*b* is also hydrophilized, as shown in FIG. 3(*e*). Whereupon, the entire surface of photosensitive layer 3 is hydrophilized to thereby have a contact angle up to 10° against water 6. In other words, the entire surface regains the state of FIG. 2, so that image area 3*b* is completely deleted at step (S240) of deleting written image.

At the same time, the surface of photosensitive layer 3 is heated in addition to being irradiated with the activating light, which is one of the advantageous features of the present invention. Specifically, heating of the surface of photosensitive layer 3 under irradiation with the activating light decomposes the organic compound applied to the surface of photosensitive layer 3 whereupon the image formed on the printing plate 5 can be deleted in a shorter time.

Figure 6:
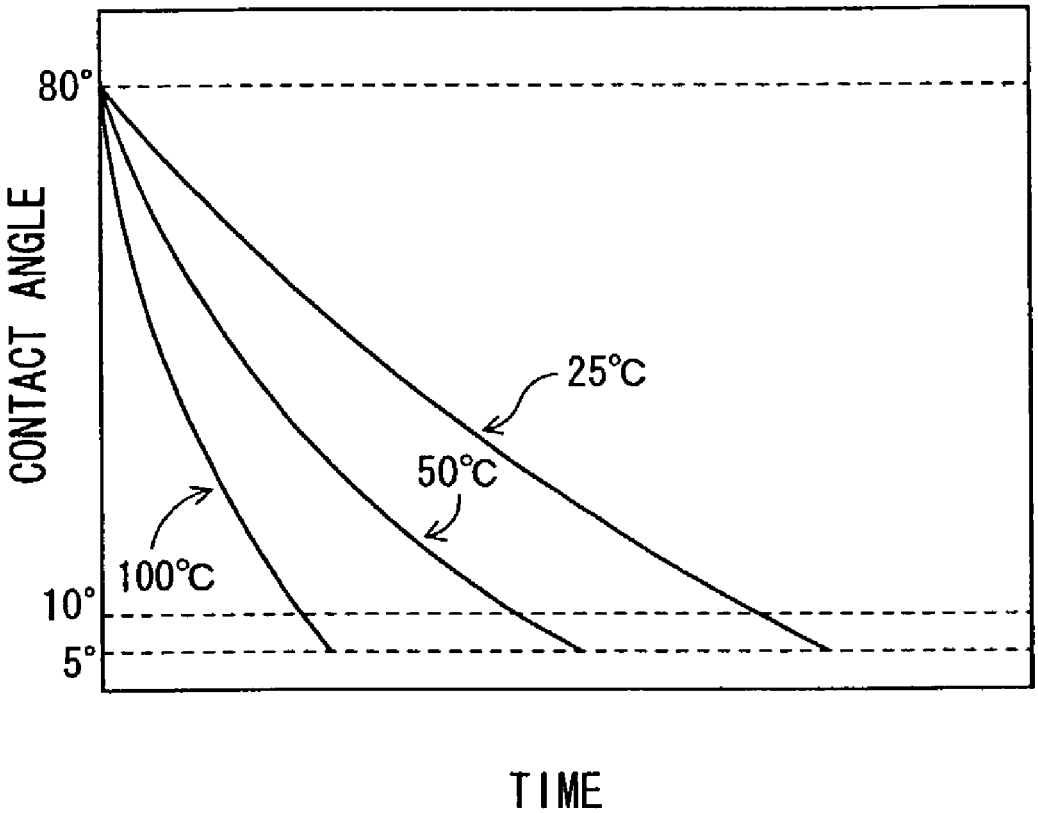
FIG. 6 is a graph showing a relationship between a heating temperature and a time length required for hydrophilization of a printing plate in a step of deleting a print image formed on the printing plate according to the first embodiment.

As shown in FIG. 6, the higher the temperature to heat the surface of photosensitive layer 3 under irradiation with the activating light is, the shorter the time required until the contact angle against water 6 becomes up to 10° (i.e., time required to hydrophilize the surface of photosensitive layer 3) is. Heating of the surface of photosensitive layer 3 can therefore promotes the hydrophilization of the surface of printing plate 5.

In the illustrated example of FIG. 3(*e*), an ultraviolet (UV) lamp is used to irradiate the surface of photosensitive layer 3 with the activating light and an infrared (IR) lamp is used to heat the surface of photosensitive layer 3.

A preferred manner of heating the surface of photosensitive layer 3 is performed by blowing hot air on the surface or by irradiating the surface with light. The preferred irradiation light is infrared light because of greater heat efficiency.

Alternatively, the surface of photosensitive layer 3 may be heated from the inside of plate cylinder 11 around which printing plate 5 is mounted by a heating device installed inside plate cylinder 11. But, since this heating manner results in an unduly high temperature of plate cylinder 11, the unduly high temperature may cause changes of ink viscosity and other properties that affect the print result quality at the subsequent step (S220) of printing), the heater inside plate cylinder 11 should be adopted considering the influence of the ink properties.

After the hydrophilization by heat under irradiation with the activating light at the step (S240) of deleting a formed image, photosensitive layer 3 whose entire surface retains hydrophilicity, is subjected to the step (S200) of hydrophobizing the surface by applying the organic compound again, as shown in FIG. 3(*a*). An action and/or an interaction between photosensitive layer 3 and the applied organic compound changes a property of the surface of photosensitive layer 3 from hydrophilic to hydrophobic (namely, performing of hydrophobization) so that photosensitive layer 3 returns to the initial state in the making of the printing plate.

Figure 7:
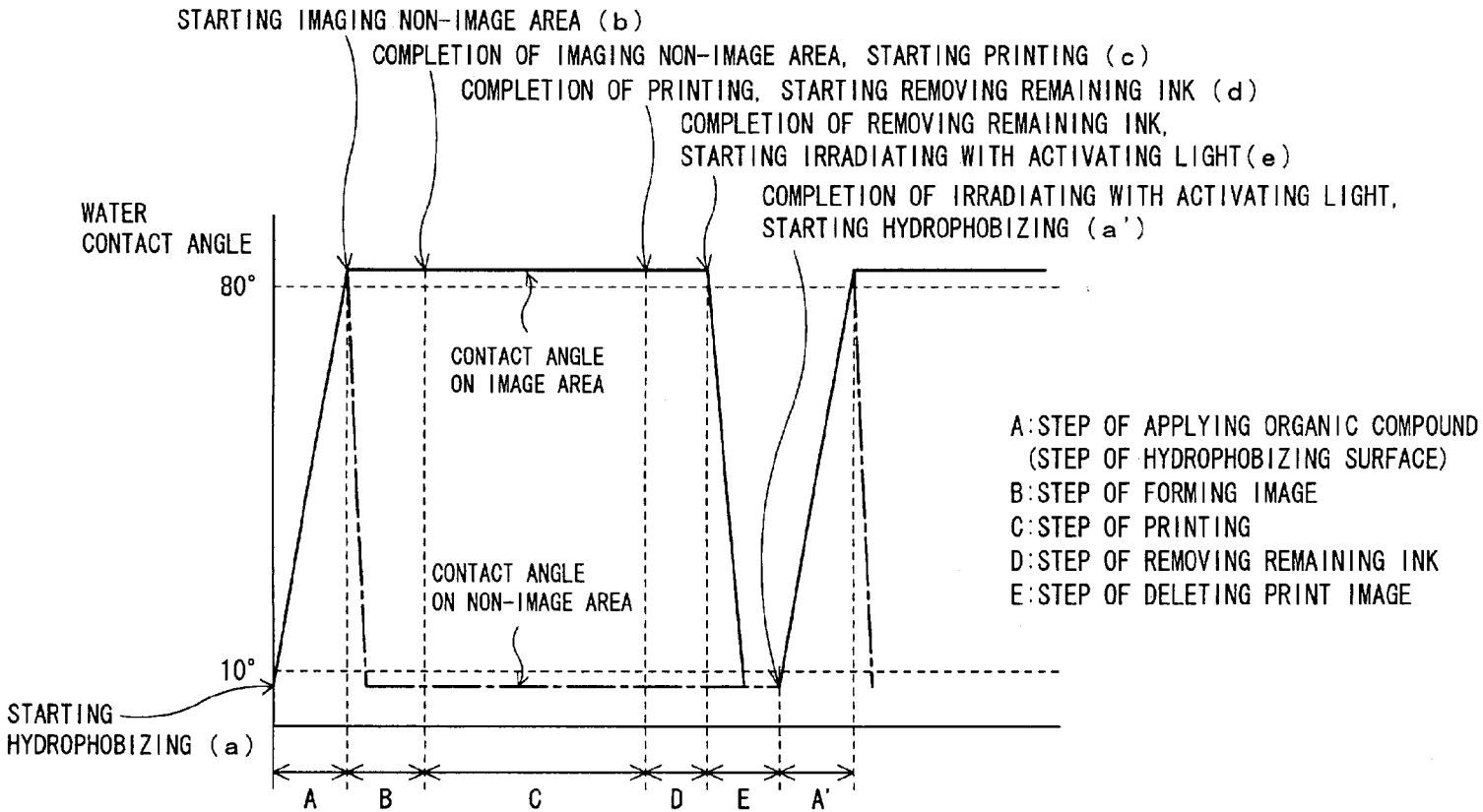
FIG. 7 is a graph showing a relationship between water contact angle of a printing plate and time (or procedural steps) according to the first embodiment.

The graph in FIG. 7 illustrates all of the steps described above. The abscissa of the graph represents the time passage (the performed procedural steps); and the ordinate, the contact angle of water 6 on the surface of printing plate 5. The graph indicates the change of the contact angle of water 6 applied to the surface of photosensitive layer 3 in accordance with the time passage or performance of the procedural steps. In other words, the contact angle in the graph reveals whether the surface of photosensitive layer 3 is hydrophobic or hydrophilic at respective time points. The one-dotted line in the graph represents the contact angle of water 6 on non-image area 3*a*; and the solid line, that on image area 3*b*.

First of all, the surface of photosensitive layer 3 is irradiated with the activating light to be in a high hydrophilic state in which the contact angle against water 6 is up to 10°.

In the subsequent step (S200) of hydrophobizing the surface (Step A in FIG. 7), the organic compound is applied onto the surface of photosensitive layer 3 to conduct an action and/or an interaction with photosensitive layer 3, so that the surface of photosensitive layer 3 changes from hydrophilic to hydrophobic. Namely, the surface of photosensitive layer 3 in a hydrophobic state has a contact angle of 50° or greater, preferably, 80° or greater against water 6. Time point (a) in FIG. 7 indicates the start of hydrophobization, and time point (b) indicates completion of the hydrophobization at which printing plate 5 is in the initial state in the making of the printing plate.

The surface of photosensitive layer 3 is irradiated with the activating light in order to start writing non-image area 3*a* on the surface at the time point (b) in the next step (S210) of forming an image (step of writing non-image area; Step B in FIG. 7). Thereby, one or more portions of the surface of photosensitive layer 3, which portions have been irradiated with the activating light, change from hydrophobic to hydrophilic so that the portions in a hydrophilic state have a contact angle up to 10° against water 6. On the other hand, the remaining one or more portions which have not been irradiated with the activating light maintain hydrophobicity whereupon the remaining portions becomes image area 3*b*. A combination of non-image area 3*a*, including one or more portions which have been irradiated with the activating light, and image area 3*b* functions as a printing plate.

After completion of writing non-image area 3*a*, printing is started to accomplish the step (S220) of printing (Step C in FIG. 7) (at time point (c) in FIG. 7).

Further, upon completion of printing, ink, dust or the like remaining on photosensitive layer 3 is removed in step (S230) of removing ink (step D in FIG. 7) (at time point (d) in FIG. 7).

After completion of removing ink, the step (S240) of deleting a formed image (step E in FIG. 7) is performed by irradiating the surface of photosensitive layer 3 with the activating light and concurrently by heating the surface of photosensitive layer 3 (at time point (e)), whereby the photocatalyst on photosensitive layer 3 rapidly decomposes and removes hydrophobic image area 3*b*. At the same time, the photocatalyst further changes to hydrophilic from hydrophobic so that the entire surface of photosensitive layer 3 is hydrophilized. Namely, performing of step (S240) of deleting the formed image succeeds in deleting the written image completely.

After that, the organic compound is applied onto the surface of photosensitive layer 3 again in the next step (S200) of hydrophobizing the surface (Step A' in FIG. 7). An action and/or an interaction between the applied organic compound and photosensitive layer 3 (at time point (a') in FIG. 7) cause printing plate 5 to revert to the initial state in the making of the printing plate for future reuse.

Figure 8:
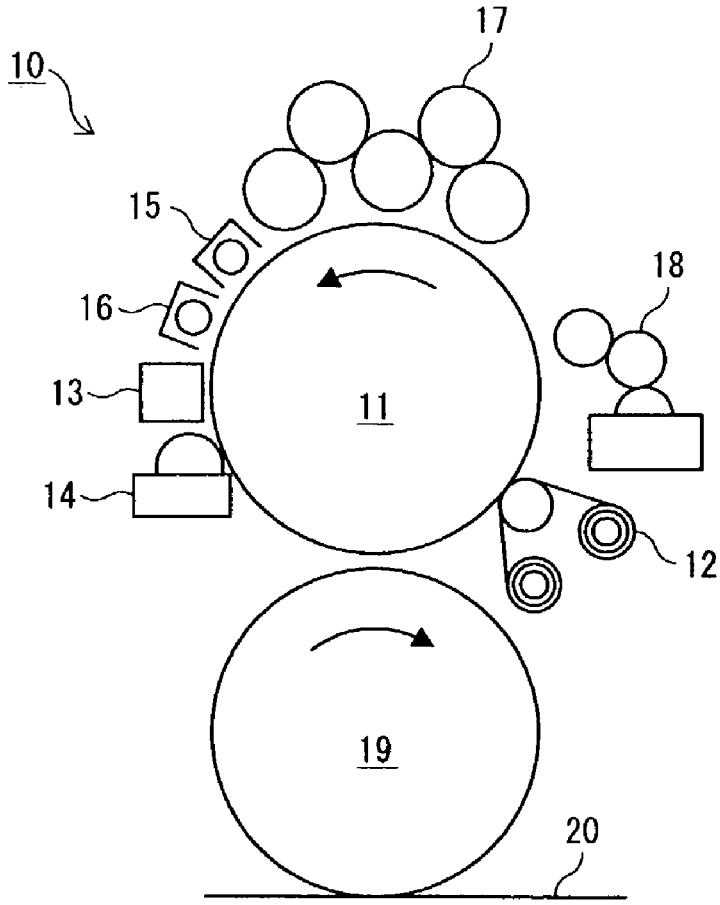
FIG. 8 is a diagram schematically showing a printing press printing an image formed on a printing plate and regenerating the printing plate according to the first embodiment.

The above printing and regenerating of a printing plate are preferably performed in print system (printing press) 10 shown in FIG. 8.

Printing press 10 comprises plate cylinder 11 disposed in the center thereof, and additionally includes plate cleaning unit 12, imaging unit 13, organic compound applier 14, heating device 15, hydrophilizing activating light emitting unit 16 serving as an apparatus to delete a formed image, inking rollers 17, fountain solution feeder 18, and blanket cylinder 19, which are disposed around plate cylinder 11. Printing plate 5 is mounted around the surface of plate cylinder 11.

A method of making and regenerating a printing plate will now be described with reference to FIG. 8. Plate cleaning unit 12 in contact with plate cylinder 11 wipes off ink, the fountain solution and paper dusts remaining on the surface of printing plate 5. Plate cleaning unit 12 of FIG. 8 takes the form of a reeling cloth tape to wipe off ink, although plate cleaning unit 12 should be by no means limited to such a tape.

After wiping off, plate cleaning unit 12 is disengaged from plate cylinder 11, and then the surface of printing plate 5 is heated by heating device 15 and irradiated with the activating light by hydrophilizing activating light emitting unit 16 to be thereby hydrophilic. In the illustrated example, the activated light is ultraviolet light whose wavelength is up to 400 nm. Alternatively, if a photocatalyst included in photosensitive layer 3 is activated by light having a wavelength of 400 nm to 600 nm, the activating light may be one having a wavelength of 400 nm to 600 nm.

Then organic compound applier 14 applies the organic compound onto the surface of printing plate 5 so that the entire surface of printing plate 5 is hydrophobized by an interaction with photosensitive layer 3 and the applied organic compound. In FIG. 8, a roller-shaped part serves to function as organic compound applier 14, which should, however, by no means be limited to a roller.

Upon completion of the hydrophobization, imaging unit 13 irradiates one or more portions corresponding to the prepared digital image data with the activating light to write non-image area 3*a* on the printing plate 5 (namely, forming an image on the printing plate 5).

After that, inking rollers 17, the fountain solution feeder 18, and blanket cylinder 19 are moved so as to be in contact with plate cylinder 11, and paper 20 is disposed so as to be in contact with blanket cylinder 19. Plate cylinder 11 and blanket cylinder 19 respectively rotate in the directions indicated by respective arrows whereby the fountain solution and ink are subsequently applied onto printing plate 5, and the formed image is printed on paper 20.

A succession of procedural steps for regenerating printing plate 5 can be completely performed by printing press 10 because printing press 10 comprises plate cleaning unit 12 to clean the surface of printing plate 5 mounted on plate cylinder 11, hydrophilizing activating light emitting unit 16 to delete an image area (a formed image) by irradiation with the activating light, organic compound applier 14 to apply the organic compound onto the surface of printing plate 5, heating device 15 to promote hydrophobization of printing plate 5 by heating the printing plate surface, which plate cleaning unit 12, hydrophilizing activating light emitting unit 16, organic compound applier 14 and heating device 15 serve as an apparatus for regenerating a printing plate. Additionally included imaging unit 13 to form an image on printing plate 5 allows printing press 10 to execute the succession of procedural steps of making and regenerating printing plate 5 with printing plate 5 continuing mounted on plate cylinder 11. With this configuration, it is possible to continue printing without stopping printing press 10 or changing printing plate 5.

Printing press 10 of the illustrated example includes printing plate 5 mounted around plate cylinder 11, although printing plate 5 should by no means be limited to this. Alternatively, photosensitive layer 3 may be directly formed on plate cylinder 11, that is, plate cylinder 11 and printing plate 5 are joined together into an integrated form.

Hereinafter, a description is made in relation to printing plate 5, a succession of procedural steps of making and regenerating printing plate 5 according to the first embodiment with reference to the results of experiment and observation by Inventors.

Preparation of Catalyst:

The stirred Ammonia solution was added to a starting material of a titanium sulfate (a product of Wako Pure Chemical Industries, Ltd.) to obtain a titanium sulfate hydrolysate, which was filtered through a Buchner funnel. The residue titanium sulfate hydrolysate was washed with deionized water until electrical conductivity of the filtrate came to be 2 $\mu$S/cm or smaller. After washing, the hydrolysate was dried at room temperature and then burned in the atmosphere for two hours at 400° C. The burned product was roughly milled with a mortar, so that a powder-form photocatalyst was obtained.

Confirmation of Visible-Light Activity:

The above powder-form photocatalyst (0.2 g) was evenly spread over the bottom of a sealable cylindrical reaction container (500 ml) made of PYREX® glass. The atmosphere in the reaction container was deaerated and substituted with highly-purified air. Acetone (500 ppm) was added into the reaction container and was absorbed into the photocatalyst in a dark place for 10 hours at 25° C. until the contents in the reaction container reached absorption equilibrium. After that, the contents were irradiated with light (having the major wavelength of 470 nm) emitted from a blue LED (produced by Nichia corporation). As a result of a follow-up measurement on amounts of acetone and carbon dioxide ($CO_2$) using a gas chromatograph manufactured by Shimazu Corporation, Inventors confirmed that irradiation with light emitted from the blue LED for 25 hours decomposed all acetone in the reacting container and generated carbon dioxide whose amount corresponded to the stoicheiometry proportion of the acetone. Namely, Inventors confirmed that the photocatalyst was activated by light having a wavelength of 470 nm.

Making of a Printing Plate:

The above powder-form photocatalyst was dispersed in deionized water to obtain slurry (solid content 20 w %), which was milled in a wet mill (product name: dyno mill PILOT). The resultant solution was used as a photocatalytic dispersed solution.

Alkaline degreasing was performed on a stainless-steel (SUS304) board whose area was 280×204 mm and thickness was 0.1 mm to prepare substrate 1.

Substrate 1 was dip-coated with the mixture of the photocatalytic dispersed solution and TKC-301 (trade name for a titanium dioxide coating formulation; product of Tayca Corporation) at a weight ratio of 1:8, and was then heated at 350° C. to form photosensitive layer 3 containing a photocatalyst on the surface of substrate 1, which was to be served as a precursor of printing plate 5. Photosensitive layer 3 had a thickness of approximately 0.1 $\mu$m. As a result of measurement using Contact Angle Meter, Model CA-W (trade name; manufactured by KYOWA INTERFACE SCIENCE CO., LTD.), the surface of printing plate 5 formed a contact angle of 8° in relation to water thereon, which angle is enough to exhibit hydrophilicity.

Preparation of a Hydrophobizing Solution:

Organic compound, namely, titanium-i-propoxyoctylene glycol (2 g, product of Nippon Soda Co. , Ltd.) was dissolved in a paraffin solution (98 g, product name ISOPAR® manufactured by Exxon Mobile Corporation), and the resultant solution was used as hydrophobizing solution X.

The printing plate 5 in a hydrophilic state was installed on a desk-top offset printing press (NEW ACE PRO, trademark; manufactured by Alpha Engineering Inc.), and the hydrophobizing solution X was sprayed over the surface of printing plate 5, which was dried by a hot-air drier. After that, printing plate 5 was temporarily displaced from the printing press to measure a contact angle against water using the contact angle meter. The measured contact angle was 75° which exhibits adequate hydrophobicity so that printing plate 5 was confirmed to be in the initial state in the making of the printing plate.

Image Formation:

Subsequently, halftone dot images of halftone-dot-area percentages ranging from 10% to 100% were then formed onto the surface of printing plate 5 at 10% intervals by an imaging system utilizing semiconductor laser beams having a wavelength of 405 nm, an output of 5 mW per channel and a beam diameter of 15 μm. The measurement of contact angles using the contact angle meter confirmed that contact angles on portions imaged and not imaged by the semiconductor laser beams were respectively 8° and 75° so that the imaged and non-image portions were respectively a hydrophilic non-image area and a hydrophobic image area.

Performing of Printing:

Printing plate 5 was mounted on a NEW ACE PRO desk-top offset printing press, and the formed image was printed on sheets of paper (ibest paper) using an ink HYECOO B Crimson MZ (trade name; product of Toyo Ink Mfg. Co., Ltd.) and the fountain solution, a 1% solution of LITHOFELLOW (trade mark; product of Mitsubishi Heavy Industries, Ltd.) at a printing speed of 3,500 sheets/hour. The halftone dot images were successfully printed on the first paper sheet.

Printing Plate Regeneration:

After completion of printing, in order to delete the image area formed on the surface of printing plate 5, from which ink, the fountain solution and paper dusts remaining have been removed, the entire surface of printing plate 5 was hydrophilized by irradiation with ultraviolet light having a wavelength 254 nm and an illuminance of 10 mW/cm$^2$ emitted from a low-pressure Mercury lamp and concurrently by being heated by infrared light emitted from a halogen lamp. A slidax to adjust a voltage to be applied enables the halogen lamp to adjust the temperature at which the surface of printing plate 5 is heated. A thermister continuously measured the temperature on the surface of printing plate 5 in order to measure UV-light energy required to irradiate an image area having a contact angle of 75° until the image area enters a hydrophilic state in which contact angle is up to 100°.

Figure 9:
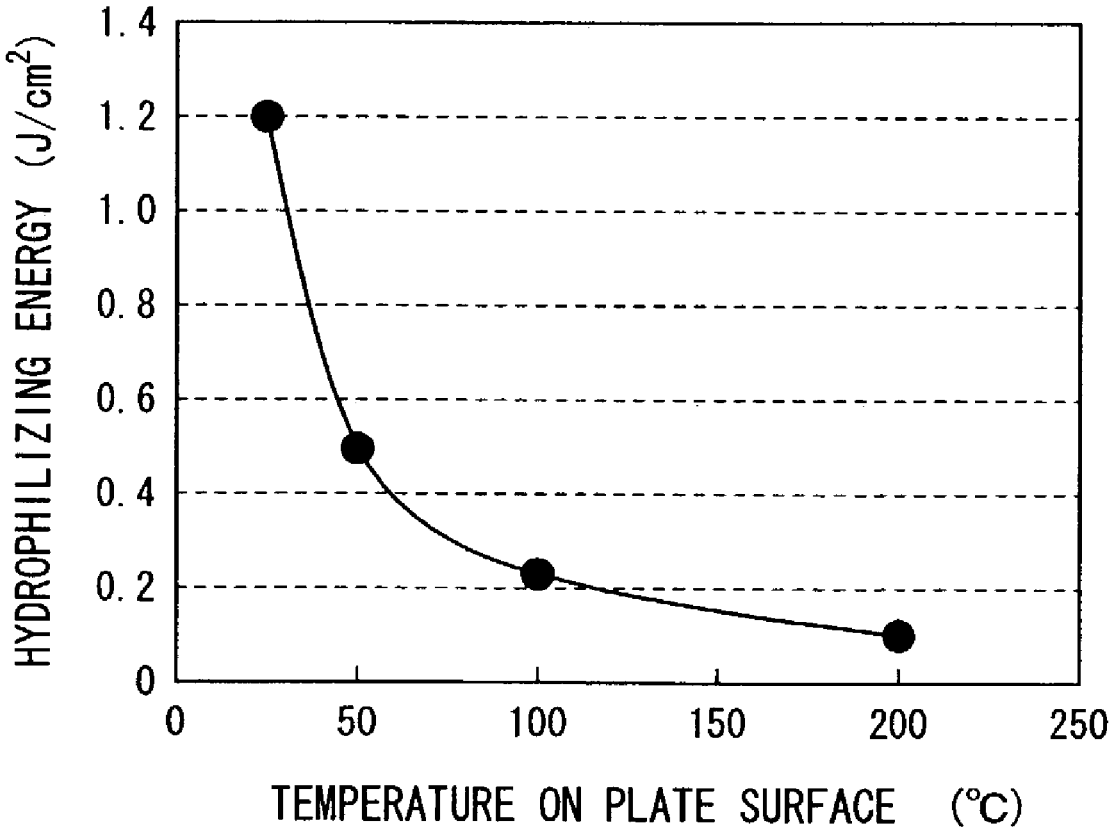
FIG. 9 is a graph showing a relationship between a temperature of the plate surface and hydrophilizing energy in the step of deleting a print image according to the first embodiment.

The graph of FIG. 9 illustrates a relationship between a temperature of the surface of printing plate 5 and hydrophilizing energy (UV-light irradiation energy) required until the entire surface of printing plate 5 becomes hydrophilic. When the surface temperature is 25° C. (without irradiation with a halogen lamp), hydrophilization required 1.2 J/cm$^2$ of UV-light irradiation energy. Irradiating the surface with a halogen lamp reduces UV-light irradiation energy required for hydrophilization in accordance with a rise in surface temperature. The UV-light irradiation energy with the surface temperature at 50° C. was reduced to half of that at 25° C.; and the energy at 200° C., to 0.1 J/cm$^2$, which corresponds to a 10-second irradiation with UV light emitted from the above Mercury lamp having an illuminance of 10 mW/cm$^2$. Namely, image deletion takes 120 seconds if the surface of printing plate 5 is not heated; and conversely, deletion of a formed image performed on a surface heated to 200° C. is completed in 10 seconds. Inventors have confirmed that heating of the surface of printing plate 5 reduces the time length required to regenerate printing plate 5. This hydrophilization made printing plate 5 reverted to the state prior to applying the organic compound, so that the regeneration of printing plate 5 succeeded.

As a result, heating the surface of printing plate 5 to approximately 50° C. and over definitely reduces irradiation energy required for hydrophilization. Meanwhile, when the surface of printing plate 5 is heated to an extremely high temperature (over approximately 200° C.), some properties of printing plate 5 may be damaged. For this reason, it is preferable that the surface of the printing plate is heated to approximately 50° C. to 200° C.

Figure 10:
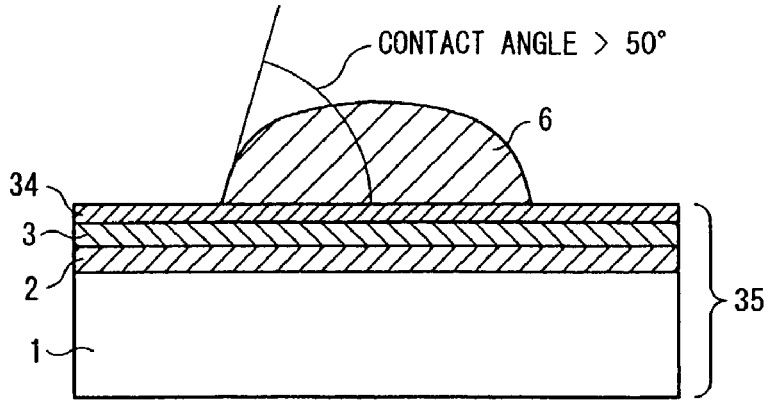
FIG. 10 is a sectional view illustrating the surface of a printing plate according to a second embodiment of the present invention, which plate exhibits hydrophobicity.
Figure 11:
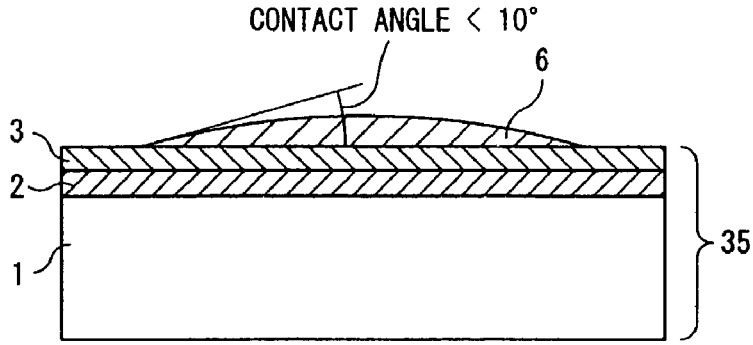
FIG. 11 is a sectional view illustrating the surface of a printing plate of the second embodiment exhibiting hydrophilicity.

(B) Second Embodiment:

FIGS. 10 and 11 respectively illustrate printing plate 35 of the second embodiment; FIG. 10 is a sectional view of the surface of printing plate 35 precursor exhibiting hydrophobicity and FIG. 11, the surface of printing plate 35 exhibiting hydrophilicity.

As shown in FIG. 10, printing plate 35 basically includes substrate 1, intermediate layer 2, photosensitive layer 3 and melted thermoplastic resin layer 34 on which fine resin particles are melted by heat and stuck. Printing plate 35 is also simply called a "plate" and an image to be printed on paper 20 is formed on printing plate 35.

Substrate 1, intermediate layer 2 and photosensitive layer 3 are identical to those described in the first embodiment, so any repetitious description will be omitted here so that description will be made in relation to different points from the first embodiment.

In the present embodiment, the organic compounds to be applied onto the surface of photosensitive layer 3 are those belonging to type B which differ from those (type A) used in the first embodiment.

Melted thermoplastic resin layer 34 is formed by performing heat treatment on the type B organic compound applied to the surface of photosensitive layer 3.

The organic compounds (of type B) used in the second embodiment are thermoplastic resins. Such resin in the form of fine particles is applied onto the surface of a precursor by spreading water or an organic solution in which the resin is dispersed. The water or the organic solution spread on the surface is dried by blowing air, if necessary. After that, heating of a portion on which a hydrophobic image area is to be formed melts the fine resin particles on the portion into a film form, which is stuck on the surface of photosensitive layer 3 by a reaction and/or an interaction, so that the film-form resin serves as an image area. Heating is carried out by irradiation with inactivating light, by a thermal head or the like and irradiation with inactivating light is preferable. Further, a preferable heating to write an image area uses infrared light because infrared light can melt the organic compound into a film form without decomposing the compound and at the same time can conduct a reaction between photosensitive layer 3 and the compound and/or adhere the compound on photosensitive layer 3.

In this embodiment, fine thermoplastic resin particles have a property of hydrophobizing the surface of printing plate 35, after the particles are melted into film form by heat, by reacting and/or interacting with the surface of printing plate 35 or by adhering on the surface of photosensitive layer 3, and also have a property of decomposing under action of the photocatalyst caused by irradiation with the activating light. The fine thermoplastic resin particles are sometimes called an image forming material.

The term "reacting and/or adhering" means a substance melted by heat and then stuck on the surface of photosensitive layer 3 with such strength that the stuck substance adequately serves as the surface of printing plate 35 while printing is performed. The substance may or may not chemically react with photosensitive layer 3, and the adhering manner may be chemical or physical.

The fine thermoplastic resin particles have a property of hydrophobizing the surface of photosensitive layer 3 by being melted into a film form by heat and subsequently by reacting with one or more hydrophilic portions on printing plate 35 or rigidly adhering to the surface. At the same time, preferably, the fine thermoplastic resin particles do not substantially react with the surface of printing plate 35 or adhere to the surface.

The fine thermoplastic resin particles have a property of hydrophilizing the surface of photosensitive layer 3 by being melted into a film form by heat and subsequently by reacting with one or more hydrophilic portions on printing plate 35 or rigidly adhering to the surface. At the same time, preferably, the fine thermoplastic resin particles do not substantially react with the surface of printing plate 35 or adhere to the surface.

A lot of types of resin that functions as thermoplastic resins are known to the art. The thermoplastic resins preferably used in the present embodiment are operable to be formed into fine particles having a size discussed above, thereby exemplified by acryl resins such as a (meth)acrylic acid and a (meth)acrylic ester; styrene resins; styrene-acrylic such as styrene-acrylic acid resin and styrene-acrylic ester; urethane resins; phenolic resins; ethylene resins such as ethylene, ethylene-acrylic acid, ethylene-acrylic ester, ethylene-vinyl acetate and modified ethylene-vinyl acetate; and vinyl resins such as vinyl acetate, vinyl propionate, polyvinyl alcohol and polyvinyl ether.

These resins may be used singly or, if necessary, in combination. Advantageously, these resins do not generate chlorine compounds when decomposing. The solution containing fine thermoplastic resin particles also includes so-called emulsion and latex.

Figure 13:
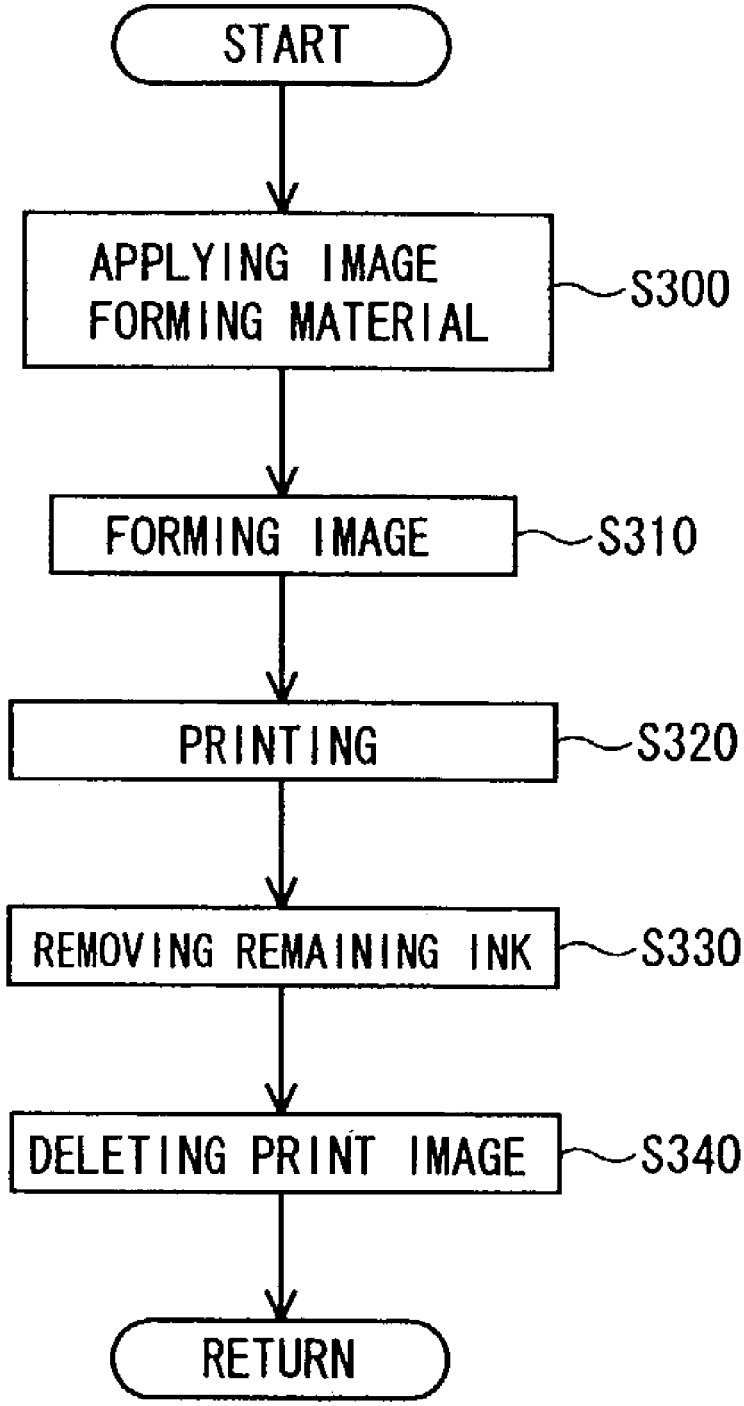
FIG. 13 is a flow diagram illustrating a succession of procedural steps of making a printing plate according to the second embodiment.

A succession of procedural steps of making and regenerating printing plate 35 according to the second embodiment will now be described. As shown in FIG. 13, making and regenerating printing plate 35 comprises the succession of procedural steps of applying an image forming material (hydrophobizing the surface) (S300), forming an image (S310), printing (S320), removing remaining ink (S330), and deleting a formed image (S340).

Procedural steps of making a printing plate will now be described.

Hereinafter, "making of a printing plate" means to form a hydrophobic image area by, after the solution containing fine resin particle (the organic compound) is applied onto the surface of photosensitive layer 3, heating at least part of the surface of printing plate 35 on the basis of the digital data. After that, fine resin particles applied on anon-image area of printing plate 35, which area has not been heated, are removed to expose hydrophilic photosensitive layer 3 so that a combination of the hydrophobic image area and the hydrophilic non-image area forms a latent image on printing plate 35.

Figure 12:
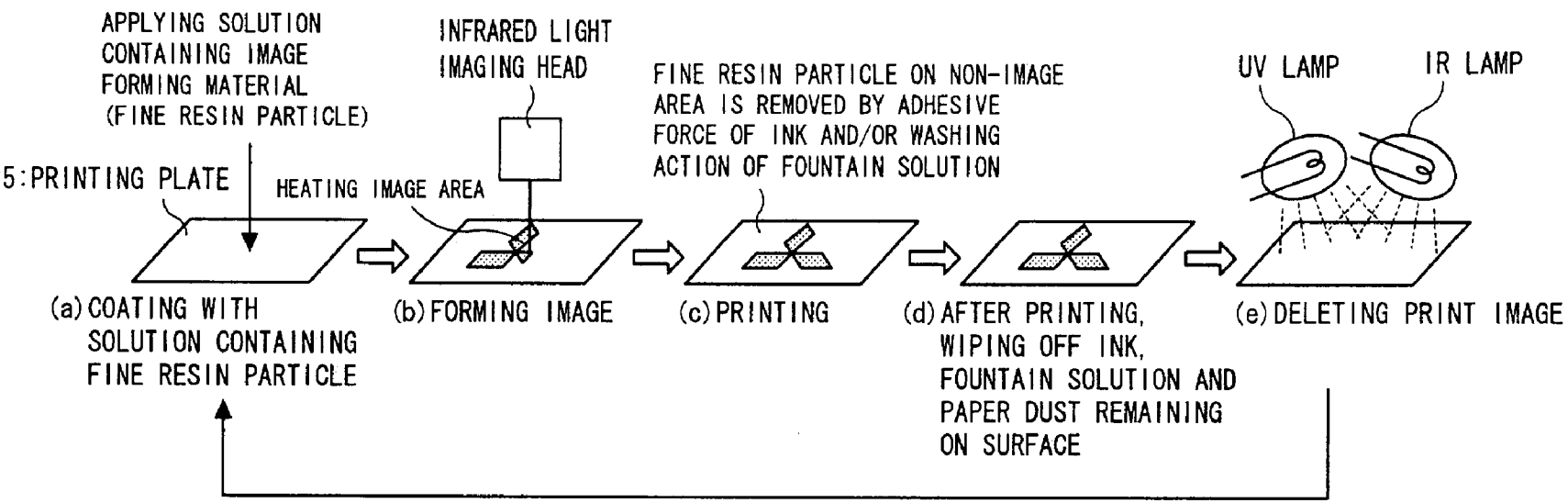
FIG. 12 is a perspective diagram illustrating a cycle of operations from image formation on a printing plate to regenerating the printing plate according to the second embodiment.

First of all, the organic compound (fine resin particles) serving as an image forming material is applied onto the surface of photosensitive layer 3, whose entire surface is hydrophilized in the prior cycle of the procedural step (of deleting the formed image (S340)) and then photosensitive layer 3 is dried at room temperature if required, as shown in FIG. 12(*a*).

This state of the surface of the photosensitive layer 3 will be called "the initial state in the making of the printing plate", which can be considered as the time of starting printing. More specifically, the initial state in the making of the printing plate can be considered to be a state whereby the digitized data representing a desired given image have already been provided and are about to be formed onto printing plate 35.

Subsequently, the desired image is formed onto the surface of photosensitive layer 3 in the image writing step (S310), as shown in FIG. 12(*b*).

The forming of the image is performed by writing an image area on photosensitive layer 3 in accordance with the digital data representing the desired image. An image area, as shown in FIG. 10, is hydrophobic and thereby has a contact angle of 50° or larger, preferably of 80° or larger against water 6, which is in such a state that printing ink is easily held but the fountain solution is hardly deposited.

In order to form a hydrophobic image area according to the digital data, a fine resin particle layer of the image area is preferably melted into a film form by heat and then reacted with and/or stuck on the surface of photosensitive layer 3. After the heating, fine resin particles on one or more portions which have not been heated are removed whereby a non-image area appears, thereby completing making of printing plate 35.

Preferably, heating is performed by irradiation with inactivating light, more specifically, infrared light.

In the illustrated example, at least part of fine resin particles applied to photosensitive layer 3 are melted into a film form by heat generated irradiation with infrared light emitted from an infrared-light imaging head, and then the film-form resin reacts with and/or adheres to the surface of photosensitive layer 3 to form an image area, as shown in FIG. 12(*b*).

After writing the image area, fine resin particles on the portions on which the image has not been formed are removed from printing plate 35 by an adhesive force of the ink and/or a washing action of the fountain solution, so that the non-image area appears, as shown in FIG. 12(*c*). This forms the image and non-image areas whereupon printing plate 35 becomes ready to perform printing.

In the illustrated example, irradiation by infrared light writes an image area. As an alternative, a thermal head directly heats melted thermoplastic resin layer 34 to write the image area.

After completion of removing the fine resin particles on the non-image area, a so-called emulsion ink of a mixture of a hydrophobic printing ink and the fountain solution is applied onto the surface of printing plate 35 in the step (S320) of printing shown in FIG. 12(*c*). This completes the making of printing plate 35 exemplified by FIG. 14.

Figure 14:
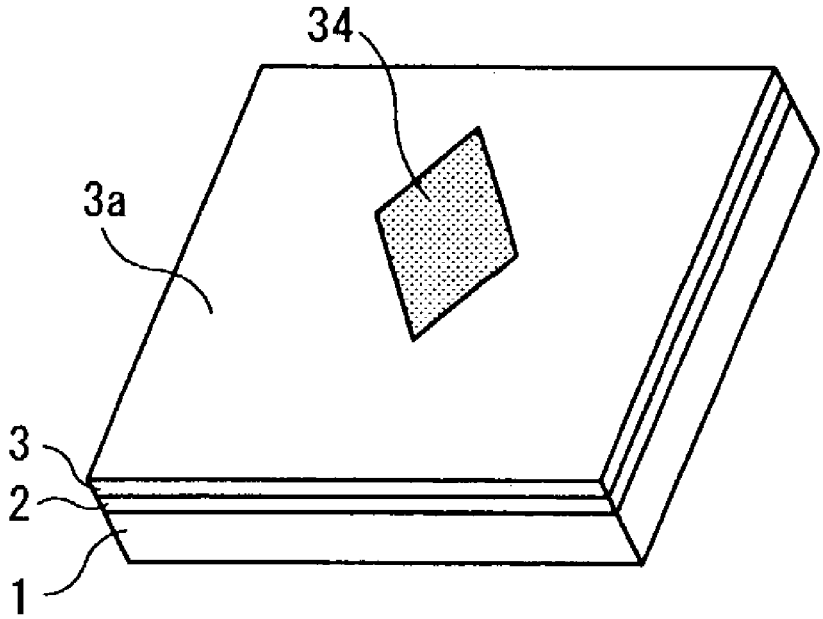
FIG. 14 is a perspective diagram schematically illustrating an example of a printing plate according to the second embodiment.

The hatching portion in FIG. 14 represents a state in which fine resin particles have been melted into a film form by heat and subsequently have reacted with or stuck on the surface of photosensitive layer 3 including photocatalyst to form melted thermoplastic resin layer 34, in other words, a state in which a hydrophobic printing ink adheres to the hydrophobic image area. Conversely, the remaining white portion (of the surface of photosensitive layer 3) represents a state in which the fountain solution preferentially adheres on, i.e., the hydrophilic non-image area, which repels the hydrophobic ink so that the ink adheres to the non-image area. The resultant photosensitive layer 3, on which an image (a printing pattern) appears, functions as printing plate 35. After that, the image is printed on paper 20 to complete the printing step.

A process of regenerating a printing plate will now be described.

"Regeneration of the printing plate" will hereinafter mean to cause printing plate 35 whose surface partially shows hydrophobicity with the remaining portion showing hydrophilicity, to be restored to the initial state in the making of the printing plate by evenly hydrophilizing the entire surface of photosensitive layer 3, subsequently by applying the solution containing fine resin particles serving as the organic compound onto the hydrophilic surface in a hydrophilic state and by, if required, drying at room temperature.

A succession of procedural steps of regenerating a printing plate is started with the step (S330) of removing remaining ink in which ink, the fountain solution, paper dust and the like remaining on photosensitive layer 3 are wiped off after completion of printing, as shown in FIG. 12(*d*).

In the subsequent step (S340) of deleting an image, the entire surface of photosensitive layer 3, part of the surface of which is in a hydrophobic state, is heated and concurrently irradiated with activating light having energy higher than a band-gap energy of the photocatalyst. Irradiation of the entire surface of photosensitive layer 3 with the activating light decomposes and removes melted thermoplastic resin layer 34, which has been formed by melted fine resin particles, so that the entire surface of photosensitive layer 3 enters a hydrophilic state in which the contact angle against water 6 thereon is 10° or smaller, as shown in FIG. 11.

In the illustrated example, ultraviolet light emitted from a UV lamp, as shown in FIG. 12(*e*), decomposes the image area to expose the hydrophilic portion of photosensitive layer 3.

At the same time, the surface of photosensitive layer 3 is heated in addition to being irradiated with the activating light, which is one of the advantageous features of the present invention. Specifically, heating of the surface of photosensitive layer 3 under irradiation with the activating light promotes the decomposition of the organic compound applied on the surface of photosensitive layer 3 whereupon the image formed on printing plate 35 can be deleted in a short time.

In the illustrated example of FIG. 12(*e*), an ultraviolet (UV) lamp is used to irradiate the surface of photosensitive layer 3 with the activating light and irradiation with inactivating light heats the surface of photosensitive layer 3. Considering heat efficiency, the preferred irradiation light for heating is infrared light.

Another preferred heating manner of the surface of photosensitive layer 3 is performed by blowing hot air on the surface.

After the step (S340) of deleting a formed image, the entire surface of photosensitive layer 3 which has returned to a hydrophilic state is coated with the solution containing fine resin particles again at room temperature, and dried at room temperature if necessary, so that printing plate 35 can revert to the initial state in the making of the printing plate.

Figure 15:
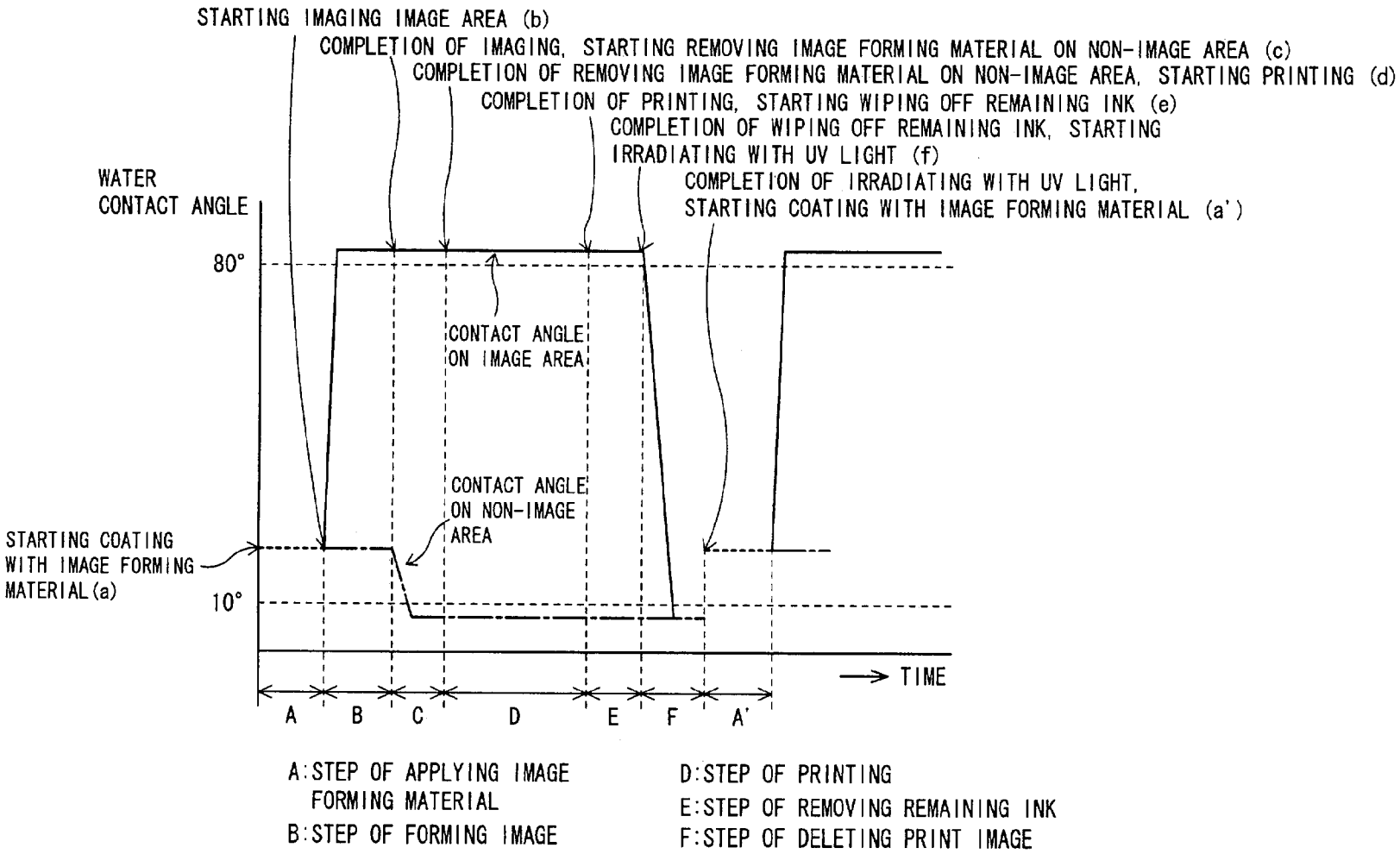
FIG. 15 is a graph showing a relationship between water contact angle of a printing plate and time (or procedural steps) according to the second embodiment.

The graph in FIG. 15 illustrates all the steps described above. The abscissa represents the time passage (the procedural steps); and the ordinate, the contact angle of water 6 on printing plate 35. The graph indicates the change of a contact angle of water 6 applied on the surface of photosensitive layer 3 in accordance with the time passage or performance of the procedural steps. The one-dotted line in the graph represents the contact angle of water 6 on a non-image area; the thick broken lines (started at time points a and a'), that common to an image area and the non-image area; and the solid line, that on the image area.

The surface of photosensitive layer 3 is irradiated with ultraviolet light to become a hydrophilic state in which the contact angle against water 6 is up to 10° in advance.

First of all, in order to perform the step (S300) of applying an image forming material (step A in FIG. 15), the solution (the organic compound) containing fine resin particles is applied onto the surface of photosensitive layer 3 (time point (a) in FIG. 15) and, if necessary, the solution is dried at room temperature. The succession of procedural steps of FIG. 12 is dispensable with the step of drying. Upon completion of applying the solution containing fine resin particles, printing plate 35 is in the initial state in making of the printing plate (time point (b) in FIG. 15).

In the subsequent step (S310) of forming image (writing an image area; step B in FIG. 15), a heat treatment is performed on one or more portions on the surface of photosensitive layer 3 coated with fine resin particles, which portions correspond to an image area, to initiate writing of an image area (time point (b) in FIG. 15). The heating causes the fine resin particles to melt into a film form and to react with and/or adhere to the photosensitive layer 3 so that the image area exhibits high hydrophobicity. On the other hand, fine resin particles applied to a non-image area do not react with and/or adhere to the surface of photosensitive layer 3 and maintain an identical state to that before the step of forming the image.

Upon completion of writing the image area, a step of removing particles on the non-image area (step C in FIG. 15) start to remove fine resin particles applied to the non-image area from the surface of photosensitive layer 3 by utilizing an adhesive force of the printing ink and a washing action of the fountain solution (time point (c) in FIG. 15). Namely, this removal causes one or more hydrophilic portions to emerge on the surface of photosensitive layer 3 to form the non-image area. As a consequence, appearance of the hydrophobic image area formed by fine resin particles, after being melted into a film form, reacting with and/or adhering to the surface of photosensitive layer 3, and the hydrophilic non-image area from which fine resin particles have been removed causes the surface of photosensitive layer 3 to function as printing plate 35.

The completion of removing fine resin particles on the non-image area prompts the step (S320) of printing (step D in FIG. 15) (at time point (d) in FIG. 15).

After completion of printing the image, cleaning printing plate 35 is started by removing printing ink, dust and the like remaining on photosensitive layer 3 (at time point (e) in FIG. 15) to perform the step (S330) of removing remaining ink (step E in FIG. 15).

Upon completion of cleaning, i.e., removing remaining ink, the surface of photosensitive layer 3 is irradiated with the activating light and heated as in the step (S340) of deleting the formed image (step F in FIG. 15) so that the image area formed by the fine resin particle melting into a film form is rapidly decomposed and removed and concurrently the hydrophobic photocatalyst is transformed into a hydrophilic state. The transformation makes the entire surface of photosensitive layer 3 hydrophilic again. The image formed on the surface of photosensitive layer 3 is completely deleted in the step (S340) of deleting image.

In the succeeding step (S300) of applying an image forming material (step A' in FIG. 15), the solution containing fine resin particles is applied onto the surface of photosensitive layer 3 another time (at time point (a') in FIG. 15) so that printing plate 35 is restored to the initial state in making of the printing plate for future reuse.

The above printing and regenerating of printing plate 35 are preferably performed in print system (printing press) 10 shown in FIG. 8, as discussed in the first embodiment. Although, since the second embodiment utilizes the solution containing fine thermoplastic resin particles (the organic compound of type B) which solution is different from that containing the organic compound of type A used in the first embodiment, organic compound applier (a unit to hydrophobize the surface) 14 included in printing press 10 of FIG. 8 has to be designed differently from that of the first embodiment in order to be suitable for applying the solution containing the organic compound of type B.

Hereinafter, a succession of procedural steps of making and regenerating printing plate 35 according to the second embodiment will now be described with reference to the results of experiment and observation by Inventors.

Making of a Printing Plate:

Anodic oxidation was performed on a stainless-steel (SUS304) board that was to serve as substrate 1 whose area was 280×204 mm and thickness was 0.1 mm to apply a black oxide finish. This treatment improved the absorbance of the SUS board at 830 nm infrared light from 30% before the treatment to 90% or higher after the black oxide finish. Then the SUS board on which the black oxide finish has been applied was further subjected to alkaline degreasing to thereby serve as substrate 1.

Substrate 1 was dip-coated with silica sol (solid content 5% wt) and heated for 30 minutes at 500° C. so that intermediate layer 2 having a thickness of approximately 0.07 μm is formed on substrate 1.

Intermediate layer 2 was dip-coated with the mixture of TKC-203 (trade name for a photocatalyst sol; product of Tayca Corporation) and TKC-301 (trade name for a titanium dioxide coating formulation; product of Tayca Corporation) at a weight ratio of 1:4, and was then heated at 500° C. to form photosensitive layer 3 on the surface of substrate 1, which layer includes titanium dioxide of the anatase structure. Photosensitive layer 3 had a thickness of approximately 0.1 μm.

After that, the entire surface of printing plate 35 was irradiated by ultraviolet light having a wavelength 254 nm and an illuminance of 10 mW/cm$^2$ emitted from a low-pressure Mercury lamp for 10 seconds. Immediately after the irradiation, contact angle against water 6 was measured with a Contact Angle Meter, Model CA-W (trade name; manufactured by KYOWA INTERFACE SCIENCE CO., LTD.) and the result of measurement was a contact angle of 70 which is enough hydrophilicity for a non-image area.

Preparation of a Hydrophobizing Solution:

A styrene-acrylic resin (J-678, trade name; product of Johnson Polymer Corporation) was dissolved in ethanol to prepare a resin solution of 1 wt. % concentration. After a surfactant (IONET T-60-C, trade name; product of Sanyo Chemical Industries, Ltd.) was added into the resin solution at 10%wt (weight percent) based on the resin, ion-exchange water (chilled water) (30 parts by weight) was added to the resin solution (70 parts by weight) so that the resin precipitated in the form of fine particles. Subsequently, ethanol was driven off at a solution temperature of 40° C. on an evaporator and the obtained fine thermoplastic resin particles were dispersed in water to prepare hydrophobizing solution Y. Observation of the resin particles with a scanning electron microscope finds spherical particles having a particle diameter ranging from 0.07 to 0.1 μm.

Formation of an Image:

The above hydrophobizing solution was applied onto the entire surface of printing plate 35 hydrophilized by irradiation with ultraviolet light by a roll coating method and was dried for five minutes at 25° C. Subsequently, halftone dot images of halftone-dot-area percentages ranging from 10% to 100% were then formed onto the surface of printing plate 35 at 10% intervals by imaging unit 13 utilizing infrared laser beams having a wavelength of 830 nm, an output of 100 mW per channel and a beam diameter of 15 μm. The irradiation with the infrared laser beam melted fine resin particles applied on a portion irradiated and the melted resin adhered on the surface of printing plate 35 to form melted thermoplastic resin layer 34. The measurement of contact angles using a Contact Angle Meter, Model CA-W confirmed that contact angles on portions on which the fine resin particles adhered was 82° so that formation of an image area was also confirmed.

Performing of Printing:

Printing plate 35 was mounted on a New Ace-Pro desktop off set printing press manufactured by ALPHA ENGINEERING INC., and printing of the formed image is performed using ink HYECOO B Crimson MZ ink (trade name; product of Toyo Ink Mfg. Co., Ltd.) and the fountain solution, a 1% solution of LITHOFELLOW (trade mark; product of Mitsubishi Heavy Industries, Ltd.) at a printing speed of 3,500 sheets/hour. The halftone dot images were successfully printed on a paper sheet.

Regeneration of a Printing Plate:

After completion of printing, in order to delete the image area formed on the surface of printing plate 35 from which ink, the fountain solution and paper dusts remaining have been removed, the entire surface of printing plate 35 was hydrophilized by being heated by infrared light emitted from a halogen lamp and being irradiated with ultraviolet light having a wavelength 254 nm and an illuminance of 20 mW/cm$^2$ emitted from a low-pressure Mercury lamp. A slidax to adjust a voltage to be applied enables a halogen lamp to adjust the temperature at which the surface of printing plate 35 is heated. A thermister continuously measured the temperature on the surface of printing plate 35 so that UV-light energy required to irradiate an image area having a contact angle of 82° until the image area becomes hydrophilic, i.e., the image area comes to have a contact angle of up to 10°.

Figure 16:
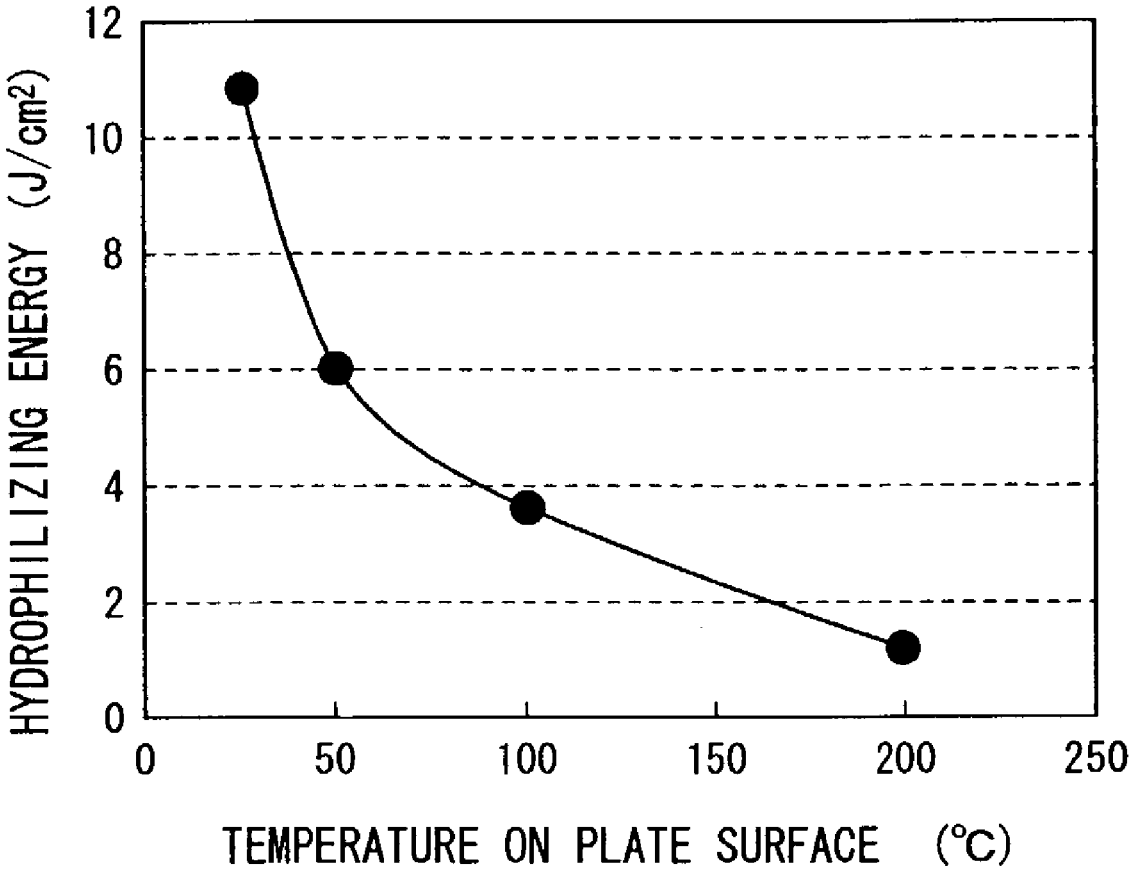
FIG. 16 is a graph showing a relationship between a temperature of the plate surface and hydrophilizing energy in the step of deleting a print image according to the second embodiment.

The graph of FIG. 16 illustrates a relationship between hydrophilizing energy (UV-light irradiation energy) required until the entire surface of printing plate 35 becomes hydrophilic and temperature of the surface of printing plate 35. When the surface temperature was 25° C. (without irradiation with a halogen lamp), hydrophilization required 10.8 J/cm$^2$ of UV-light irradiation energy. Heating of the surface by irradiation with a halogen lamp has reduced UV-light irradiation energy required for hydrophilization in accordance with a rise in surface temperature. The UV-light irradiation energy with the surface temperature at 50° C. required for hydrophilization was reduced to half of that at 25° C.; and the energy at 200° C., to 1.2 J/cm$^2$, which corresponds to 60-second irradiation with UV light emitted from the above Mercury lamp having an illuminance of 20 mW/cm$^2$. Namely, deletion of a formed image takes 540 seconds if the surface of printing plate 35 is not heated; and conversely, deleting performed over a surface heated at 200° C. is completed in 60 seconds. Inventors have confirmed that heating the surface of printing plate 35 reduces the time length required to regenerate printing plate 35. This hydrophilization restored printing plate 35 to the state prior to applying the organic compound, so that the regeneration of printing plate 35 succeeded.

As a result, heating the surface of printing plate 35 to approximately 50° C. and over definitely reduces irradiation energy required for hydrophilization. In the meanwhile, when the surface of printing plate 35 is heated to an extremely high temperature (over approximately 200° C.), some properties of printing plate 35 may be damaged. For this reason, it is preferable that the surface of printing plate 35 is heated to a temperature approximately between 50° C. and 200° C.

The printing press, the apparatus and the processes for regenerating a printing plate according to the first and the second embodiments have an advantage of a high-speed regenerating process in addition to an advantage of reusing printing plate 35. In other words, it is possible to reduce the time required to delete the image area written on printing plate 35 whereupon regeneration of printing plate 35 is accomplished in a shorter time. Additionally, the printing process can be therefore performed at a higher speed.

Realization of regeneration and reuse of printing plate 35 greatly reduces wastes discarded after completion of a succession of printing processes. The first and the second embodiments not only have ecological advantages but also economical advantages because cost for printing plate 35 can be greatly reduced.

In the above embodiments, digital data representing a desired image can be directly formed onto printing plate 35. This digitalized printing source can reduce time and cost required for all the printing processes.

Further the present invention should by no means be limited to the above-described first and second embodiments, and various changes and modifications maybe suggested without departing from the concept of the present invention.

For example, the surface of photosensitive layer 3 may be heated under irradiation with the activating light in the image deleting step. Alternatively, an image area, which requires higher hydrophilizing energy than a non-image area, may be heated to a higher temperature than that for the non-image data. Such a heating manner results in even hydrophilization of the entire surface of photosensitive layer 3. In this case, heating may be controlled based on the image data.

(C) Third Embodiment:

Making and regeneration of a printing plate according to a third embodiment will now be described.

A printing press used in this embodiment is substantially identical in configuration to that of the first embodiment, so repetitious description is omitted here and some accompanying drawings discussed in the first embodiment are referenced as required.

Figure 18:
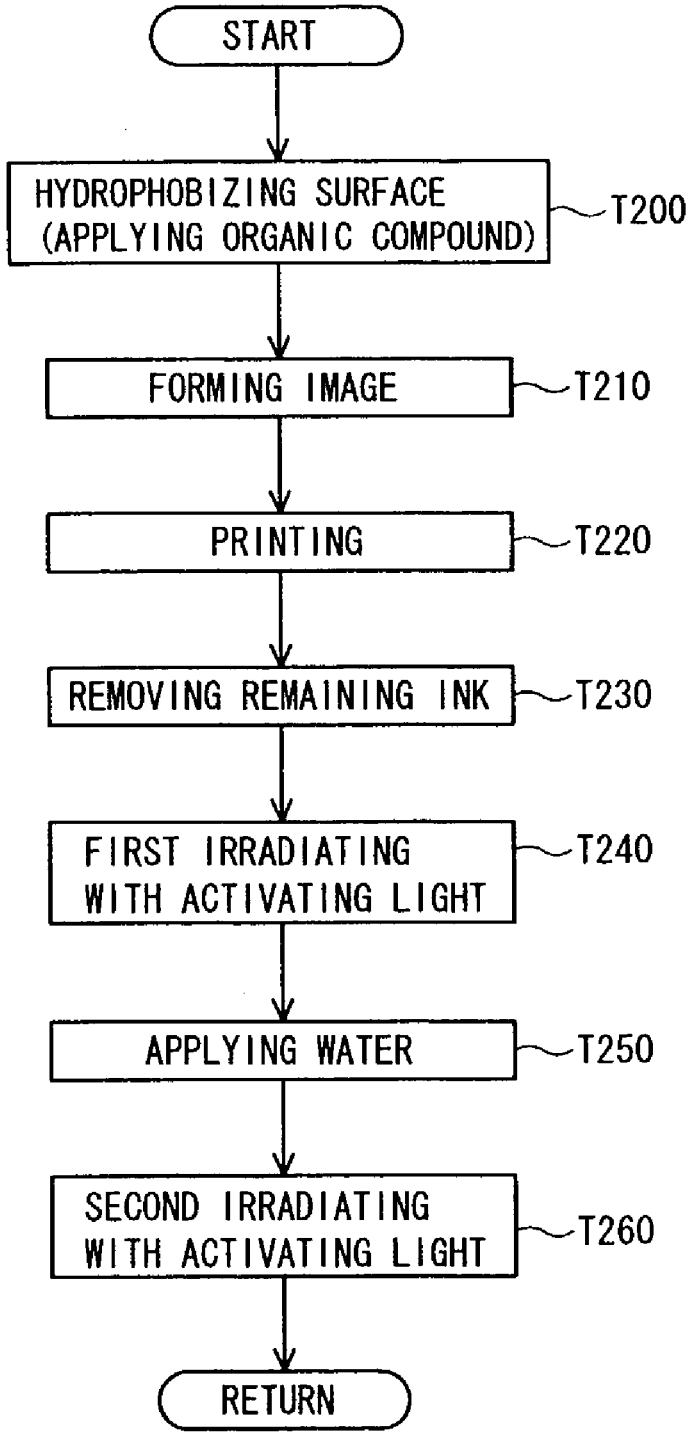
FIG. 18 is a flow diagram illustrating a succession of procedural steps of making and regenerating a printing plate according to the third embodiment.

Making and regenerating a printing plate comprises, as shown in FIG. 18, a succession of procedural steps of hydrophobizing of the surface (applying the organic compound) (T200), forming an image (T210), printing (T220), removing remaining ink (T230), first irradiating with activating light (T240), applying water (T250), and second irradiating with activating light (T260). Here, the steps of first irradiating with activating light (T240), applying water (T250), and second irradiating with activating light (T260) correspond to a step of deleting an image.

Procedural steps of making a printing plate will now be described.

Hereinafter, "making of a printing plate" means to form a hydrophilic non-image area by irradiating at least part of the surface of printing plate 5 (i.e., the surface of photosensitive layer 3) in a hydrophobic state (the initial state) with the activating light on the basis of the digital data. Whereby, a combination of the hydrophilic non-image area and a hydrophobic image area, which is not irradiated with the activated light, forms a latent image on the surface of printing plate 5.

Figure 17:
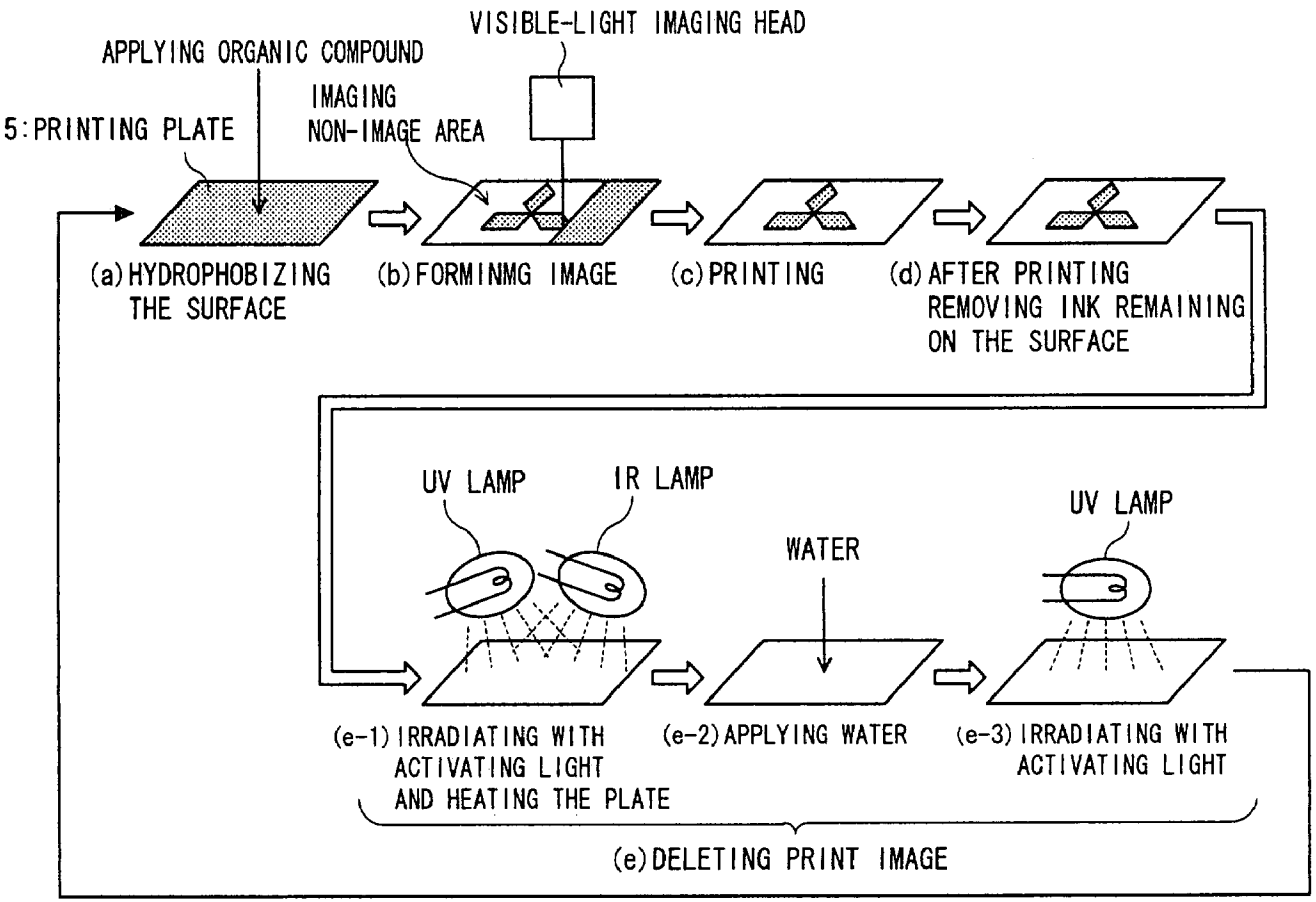
FIG. 17 is a perspective diagram illustrating a cycle of operations from image formation on a printing plate to regenerating the printing plate according to a third embodiment.

First of all, the surface of photosensitive layer 3, whose entire surface has been hydrophilized, is hydrophobized in step (T200) of hydrophobizing the surface by applying the organic compound (of type A), as shown in FIG. 17(*a*).

In the illustrated embodiment, hydrophobization of the surface of photosensitive layer 3 is carried out by irradiation of energy fluxes inactivating light, or mechanical energy generated by rubbing the surface of photosensitive layer 3.

FIG. 17(*a*) illustrates the surface of photosensitive layer 3 on which the organic compound (of type A) is applied, i.e., the hydrophobized surface in the initial state.

Here, the surface of printing plate 5 in a hydrophobic state has, as shown in FIG. 1, a contact angle of 50° or greater, preferably, 80° or greater against water 6, which is in such a state that hydrophobic printing ink is held with ease but very little fountain solution is deposited.

This state of the surface of the photosensitive layer 3 will be called "the initial state in the making of the printing plate", which can be considered to be the time of starting printing (T220). More specifically, the initial state in the making of the printing plate can be considered to indicate a state that the digitized data representing a desired given image have already been provided and are about to be formed onto printing plate 5.

Subsequently, the desired image is formed onto the surface of photosensitive layer 3 in a hydrophobic state in the step (T210) of forming an image, as shown in FIG. 17(*b*).

The forming of an image is performed by writing a non-imaged area onto photosensitive layer 3 in accordance with the digital data representing the desired image. The non-image area, as shown in FIG. 2, is hydrophilic and thereby has a contact angle up to 10° against water 6, which is in such a state that the fountain solution easily adheres but printing ink is hardly deposited.

In order to form a hydraphilic non-image area according to the digital data, photosensitive layer 3 having a photocatalyst exhibits a catalytic activity responsive to irradiation with light having a wavelength of 600 nm or shorter, i.e., activating light, is partially irradiated with the activating light. If the surface of photosensitive layer 3 is hydrophobized by the organic compound, irradiation with the activating light causes photocatalytic activity to oxidatively decompose the organic compound, so that the organic compound is removed from the surface of photosensitive layer 3. At the same time, the surface of photosensitive layer 3 becomes hydrophilic. If hydrophobization of the surface of photosensitive layer 3 has been carried out by irradiation with energy fluxes or mechanical energy, the photocatalyst responds to activating light to change from hydrophobic to hydrophilic.

On the other hand, one or more portions of the surface of photosensitive layer 3, which portions are not irradiated with the activating light, remain hydrophobic so that the surface of printing plate 5 includes one or more hydrophobic and hydrophilic portions. In other words, for example, portion 3*a* irradiated with the activating light is regarded as a hydrophilic non-image area and portion 3*b* not irradiated with the activating light is regarded as a hydrophobic image area so that printing plate is made, as illustrated in FIG. 5.

In FIG. 17(*b*), an imaging head utilizing visible light, for example, violet laser having a wavelength of 405 nm, writes non-image area 3*a* to thereby form non-image area 3*a* on the surface of photosensitive layer 3 in a hydrophobic state.

An alternative imaging head to form hydrophilic non-image area 3*a* in accordance with the digital image data other than the one utilizing violet laser having a wavelength of 405 nm may be any type and shape utilizing activating light to write an image exemplified by an imaging head equipped with a light source to emit light of wavelengths of 360 to 450 nm and a micro-mirror whose product name is the UV-SETTER® 710 manufactured by basysPrint GmbH.

After completion of the step (T210) of forming an image, image and non-image areas are already formed on the surface of the photosensitive layer 3, as shown in FIG. 17(*c*) whereupon the desired image is ready to be printed in the subsequent step (T220) of printing.

At the step (T220) of printing, a so-called emulsion ink of a mixture of a hydrophobic printing ink and the fountain solution is applied onto the surface of printing plate 5.

As a result of applying an emulsion ink onto the surface illustrated in FIG. 5: on the hatching portion (that is, hydrophobic image area) 3*b* holds the hydrophobic printing ink; and the remaining white portion (that is, hydrophilic non-image area) 3*a* preferentially holds the fountain solution while the hydrophobic ink is repelled so that the ink is not deposited on a non-image area 3*a*. Photosensitive layer 3 on which an image (a printing pattern) emerges functions as printing plate 5. After that, the image is printed on paper 20 to accomplish the step of printing in due course.

Processes of regenerating printing plate 5 will now be described.

Regeneration of the printing plate will hereinafter means to cause printing plate 5 whose surface partially displays hydrophobicity with the remaining part displaying hydrophilicity, to be restored to the initial state in the making of the printing plate by evenly hydrophilizing the entire surface of photosensitive layer 3, and by applying the organic compound onto the photosensitive layer 3 to conduct a reaction and/or an interaction performed by photosensitive layer 3 and the organic compound, by irradiating the surface of photosensitive layer 3 with energy fluxes or by applying mechanical energy so that the surface of photosensitive layer 3 in a hydrophilic state changes to display a hydrophobic state.

Evenly hydrophilizing the entire surface of printing plate 5, which is performed prior to hydrophobization of printing plate 5, aims to completely delete the formed image.

First of all, the step (T230) of removing remaining ink is started by removing ink, the fountain solution, and a paper dust remaining on the surface of photosensitive layer 3, which has completed printing, as shown in FIG. 17(*d*). Removal of remaining ink is carried out by being transmitted onto paper after the supply of ink onto the surface of printing plate 5 is stopped, by wiping off using a reeling cloth tape, by wiping off using a roller around which cleaning cloth is wrapped, by spraying cleaning solvent onto the surface of printing plate 5, or the like.

After that, in the step (T240) of first irradiating with the activating light shown in FIG. 17(*e*-1), the entire surface of photosensitive layer 3, part of which is in a hydrophobic state, is irradiated with activating light having energy higher than a band-gap energy of the photocatalyst. Image area 3*b* is decomposed by irradiating the entire surface of photosensitive layer 3 with activating light.

In the illustrated example, irradiation with ultraviolet light emitted from an ultraviolet lamp decomposes the image area, as shown in FIG. 17(*e*-1).

Concurrently with the irradiation with the activating light, the surface of photosensitive layer 3 may be heated to decompose and remove the organic compound applied on the surface of photosensitive layer 3 so that the image area is deleted in a shorter time.

Here, as shown in FIG. 17(*e*-1), an ultraviolet (UV) lamp is used to irradiate the surface of photosensitive layer 3 with the activating light and an infrared (IR) lamp is used to heat the surface of photosensitive layer 3.

A preferred manner to heat of the surface of photosensitive layer 3 is performed by blowing hot air onto the surface or by irradiating the surface with light. The preferred irradiation light is infrared light, considering heat efficiency.

In the step (T240) of first irradiating with the activating light, irradiating the surface of printing plate 5 with the activating light causes decomposition and removal of image area 3*b* written on the surface of printing plate 5 and at the same time causes hydrophilization of the surface of photosensitive layer 3. The steps (T250, T260) of applying water and second irradiation with the activating light that are performed subsequent to the step (T240) of first irradiating with the activating light ensure complete and rapid hydrophilization.

Since absorbing of a hydroxy group (—OH) generated by decomposition of water responsive to a photocatalytic action on the surface of a photocatalyst is assumed to cause hydrophilization of the surface containing the photocatalyst under irradiation with the activating light, the hydrohilization of printing plate 5 is advantageously performed by irradiation with the activating light under the presence of water (in the form of moisture in the air or liquid). For this reason, water is applied onto the surface of the photocatalyst to promote the generation of hydroxy groups.

Since a heated atmosphere contains less liquid water and the relative humidity decreases around printing plate 5, the surface of printing plate 5 did not sometimes exhibit hydrophilicity in which a contact angle against water is up to 10° even if the organic compound has been successfully removed in the step (T240) of first irradiating with activating light.

As a solution, after the organic compound is rapidly decomposed and removed by irradiating with the activating light with a heated atmosphere in the step (T240) of first irradiating with the activation light in the present embodiment, the surface of printing plate 5 is wet with water in the step (T250) of applying water and is irradiated with the activating light in the subsequent step (T260) of second irradiating with the activating light so that the surface of printing plate 5 is rapidly and completely hydrophilized. Thereby, the entire surface of photosensitive layer 3 becomes a hydrophilic state in which a contact angle of water 6 is up to 10°, i.e., to be in the state of FIG. 2.

In the illustrated example described with reference to FIGS. 17 and 18, the step (T260) of second irradiating with the activating light takes place after the step (T250) of applying water. Alternatively, the steps (T250, T260) of applying water and second irradiation with the activating light may be performed in parallel. Namely, irradiation with the activating light may be carried out by applying water onto printing plate 5, whereupon hydrophilization of the surface of printing plate 5 is rapidly accomplished.

In the step (T250) of applying water, a hydrogen peroxide aqueous solution may be applied as a substitute for water. The hydrogen peroxide aqueous solution enhances not only generation of hydroxy groups but also decomposition of the minute amount of the organic compound remaining on the surface of printing plate 5 so that the formed image can be further completely deleted.

After completion of the steps (T240, T250 and T260) of first irradiating with the activating light, applying water and second irradiating with the activating light, the organic compound (of type A) is applied to the entire surface of photosensitive layer 3, which has been restored to hydrophilicity, at room temperature again and, if necessary, dried at room temperature to return photosensitive layer 3 into the initial state in the making of printing plate 5.

Alternatively, as mentioned above, the character of photosensitive layer 3 (the photocatalyst) may be changed from hydrophilic to hydrophobic by irradiating the surface of photosensitive layer 3 with energy fluxes of inactivating light or by applying mechanical energy generated by rubbing the surface of photosensitive layer 3 to return photosensitive layer 3 to the initial state in the making of printing plate 5.

The graph in FIG. 7 illustrates all the steps described above. The abscissa represents the time passage (the procedural steps); and the ordinate, the contact angle of water 6 on the surface of printing plate 5. The graph indicates the change of the contact angle of water 6 applied on the surface of photosensitive layer 3 in accordance with the time passage or performance of the procedural steps. In other words, the contact angle in the graph reveals whether the surface of photosensitive layer 3 is hydrophobic or hydrophilic at respective time points. The one-dotted line in the graph of FIG. 7 represents the contact angle of water 6 on non-image area 3*a*; and the solid line, that on image area 3*b*.

First of all, the surface of photosensitive layer 3 is irradiated with the activating light to show a high hydrophilicity having a contact angle against water 6 up to 10°.

In the subsequent step (T200) of hydrophobizing the surface in a hydrophilic state (Step A in FIG. 7), the organic compound (of type A) is applied onto the surface of photosensitive layer 3 to conduct an action and/or an interaction with photosensitive layer 3, by irradiating the surface with energy fluxes, or by applying mechanical energy caused by rubbing the surface of photosensitive layer 3, so that the surface of photosensitive layer 3 changes from hydrophilic to hydrophobic. Namely, the hydrophobic surface of photosensitive layer 3 has a contact angle against water 6 of 50° or greater, preferably, 80° or greater, as shown in FIG. 1. Time point (a) in FIG. 7 indicates starting of hydrophobization, and time point (b) indicates completion of the hydrophobization at which printing plate 5 is in the initial state in the making of the printing plate.

The surface of photosensitive layer 3 is irradiated with the activating light in order to start writing non-image area 3*a* on the surface at the time point (b), in the next step (T210) of forming an image (Step B in FIG. 7). Thereby, one or more portions of the surface of photosensitive layer 3, which portions have been irradiated with the activating light, change from hydrophobic to hydrophilic so that the hydrophilic surface has a contact angle up to 10° against water 6, as shown in FIG. 2. On the other hand, the remaining one or more portions which have not been irradiated with the activating light maintain hydrophobicity whereupon the remaining portions become image area 3*b*. A combination of non-image area 3*a*, including one or more portions which have been irradiated with the activating light, and the image area 3*b* serves to function as printing plate 5.

After completion of writing non-image area 3*a*, printing is started to accomplish the step (T220) of printing (Step C in FIG. 7) (at time point (c) in FIG. 7).

Further, upon completion of printing, ink, dust or the like remaining on photosensitive layer 3 is removed in step (T230) of removing ink (step D in FIG. 7) (at time point (d) in FIG. 7).

After the step of removing remaining ink, the surface of photosensitive layer 3 is irradiated with the activating light and at the same time heated to rapidly decompose and remove the organic compound in the step (T240) of first irradiating with the activating light, as the first step to delete an image area (Step E in FIG. 7).

In the second step (T250) of applying water, water is applied onto the surface of printing plate 5, which is irradiated with the activating light in the subsequent third step (T260) of second irradiating with activating light. The surface of photosensitive layer 3 in a hydrophobic state, rapidly and certainly changes to hydrophilic so that the entire surface of photosensitive layer 3 again exhibits hydrophilicity.

The step of deleting a formed image area comprising the steps (T240, T250 and T260) of first irradiating with the activating light, applying water and second irradiating with the activating light can completely delete the image formed on the surface of printing plate 5.

After that, as the step (T200) of hydrophobising the surface (step A in FIG. 7), the surface of photosensitive layer 3 is subjected to applying the organic compound (of type A), irradiating with energy fluxes of inactivating light, or applying mechanical energy caused by rubbing the surface of photosensitive layer 3 (at time point (a') in FIG. 7) again to revert to the initial state in the making of the printing plate for future reuse.

If the hydrophobization is performed by irradiating the surface of photosensitive layer 3 with energy fluxes of inactivating light or by applying mechanical energy caused by rubbing the surface of photosensitive layer 3, no organic compound to hydrophobize the surface of photosensitive layer 3 is present. Since it is however difficult for only ink washing to completely remove resin particles in ink absorbed or adhered on the surface of photosensitive layer 3, decomposition of organic compounds in the step (T240) of first irradiating with the activating light further ensures complete deletion of a formed image.

The step (T260) of second irradiating with the activating light may take place after the step (T250) of applying water. Alternatively, the steps (T250, T260) of applying water and second irradiation with the activating light may be performed in parallel.

A method of making and regenerating printing plate 5 will now be described with reference to FIG. 19. Plate cleaning unit 12 in contact with plate cylinder 11 wipes off ink, the fountain solution and paper dusts remaining on the surface of printing plate 5. Plate cleaning unit 12 of FIG. 19 takes the form of a reeling cloth tape to wipe off ink, although plate cleaning unit 12 should be by no means limited to such a tape.

After wiping off, plate cleaning unit 12 is disengaged from plate cylinder 11, and then the surface of printing plate 5 is heated by heating device 15 and irradiated with the activating light by hydrophilizing activating light emitting unit 16 to delete the image area 3*b* formed on printing plate 5.

Subsequently, after or while water feeder 21 applies water or a hydrogen peroxide aqueous solution onto the surface of printing plate 5, hydrophilizing activating light emitting unit 16 irradiates the surface with the activating light to hydrophilize the surface of printing plate 5.

In the illustrated example, the activated light emitted from hydrophilizing activating light emitting unit 16 is ultraviolet light whose wavelength is up to 400 nm. Alternatively, if a photocatalyst included in photosensitive layer 3 is activated by light having a wavelength of 400 nm to 600 nm, the activating light may be one having a wavelength of 400 nm to 600 nm.

Water or a hydrogen peroxide aqueous solution is applied onto the surface of printing plate 5 by a spray or a roller. Although the manner of application should by no means be limited to these examples, any suitable method can be selected and adopted.

After that, organic compound applier 14 applies the organic compound (of type A) onto the entire surface of printing plate 5 to hydrophobize the entire surface of printing plate 5 and then imaging unit 13 irradiates one or more portions to become non-image area 3*a* in accordance with the prepared digital image data with the activating light having energy higher than a band-gap energy of the photocatalyst to form hydrophilic non-image area 3*a* on printing plate 5 (namely, forming an image on printing plate 5).

Figure 19:
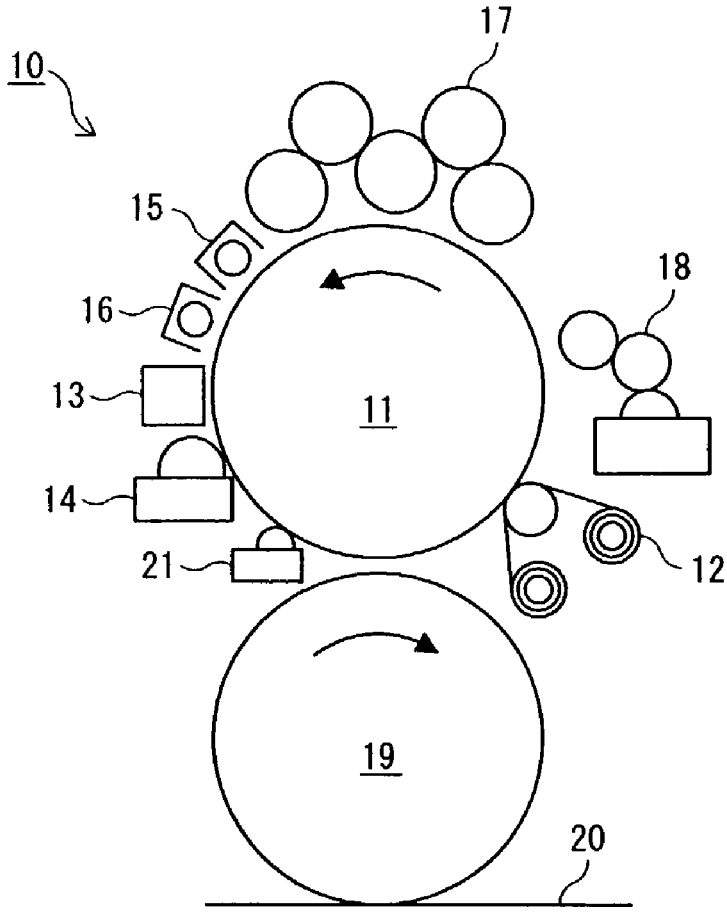
FIG. 19 is a diagram schematically showing a printing press printing an image formed on a printing plate and regenerating the printing plate according to the third embodiment.

Needless to say, if energy flux of inactivating light or the like irradiates the surface of printing plate 5, printing press 10 requires an inactivating-light emitting unit, which however does not appear in FIG. 19, to emit inactivating light with which the surface of printing plate 5 is to be irradiated; and alternatively, if mechanical energy caused by rubbing the surface of printing plate 5 is applied to hydrophobize the surface of printing plate 5, printing press 10 requires a rubbing device, which does not appear in the accompanying drawing.

After forming an image, inking roller 17, fountain solution feeder 18, and blanket cylinder 19 are moved so as to be in contact with plate cylinder 11, and paper 20 is disposed so as to be in contact with blanket cylinder 19. Plate cylinder 11 and blanket cylinder 19 respectively rotate in the directions indicated by respective arrows, whereby the fountain solution and ink are subsequently applied onto printing plate 5 and the formed image is printed on paper 20.

A succession of procedural steps for regenerating a printing plate can be performed by printing press 10 because printing press 10, in order to serve as an apparatus for regenerating a printing plate, comprises plate cleaning unit 12 to clean the surface of printing plate 5 mounted on plate cylinder 11, hydrophilizing activating light emitting unit 16 to decompose and remove an image area and hydrophilize the surface of printing plate 5 by irradiation with the activating light, water feeder 21 to apply water or a hydrogen peroxide aqueous solution onto the surface of printing plate 5, and organic compound applier 14 to apply the organic compound of type A onto the surface of printing plate 5. Additionally, imaging unit 13 included to form an image on printing plate precursor 5 allows printing press 10 to execute the succession of procedural steps of making and regenerating a printing plate with printing plate 5 containing to be mounted on plate cylinder 11. With this configuration, it is possible to continue printing operations without stopping printing press 10 or changing printing plate 5.

Additionally, heating device 15 may be included in printing press 10 as a configuration element to heat the surface of the printing plate 5 in order to decompose and remove image area 3*b* and hydrophobization of printing plate 5.

Printing press 10 of the illustrated example includes printing plate 5 mounted around plate cylinder 11, although printing plate 5 should by no means be limited to this. Alternatively, photosensitive layer 3 may be directly formed on the surface of plate cylinder 11, that is, plate cylinder 11 and printing plate 5 are joined together into an integrated form.

(D) Fourth Embodiment:

Making and regeneration of a printing plate according to a fourth embodiment will now be described.

A printing press used in this embodiment is substantially identical in configuration to the second embodiment, so repetitious description is omitted here and some accompanying drawings discussed in the second embodiment are referenced as required.

Figure 21:
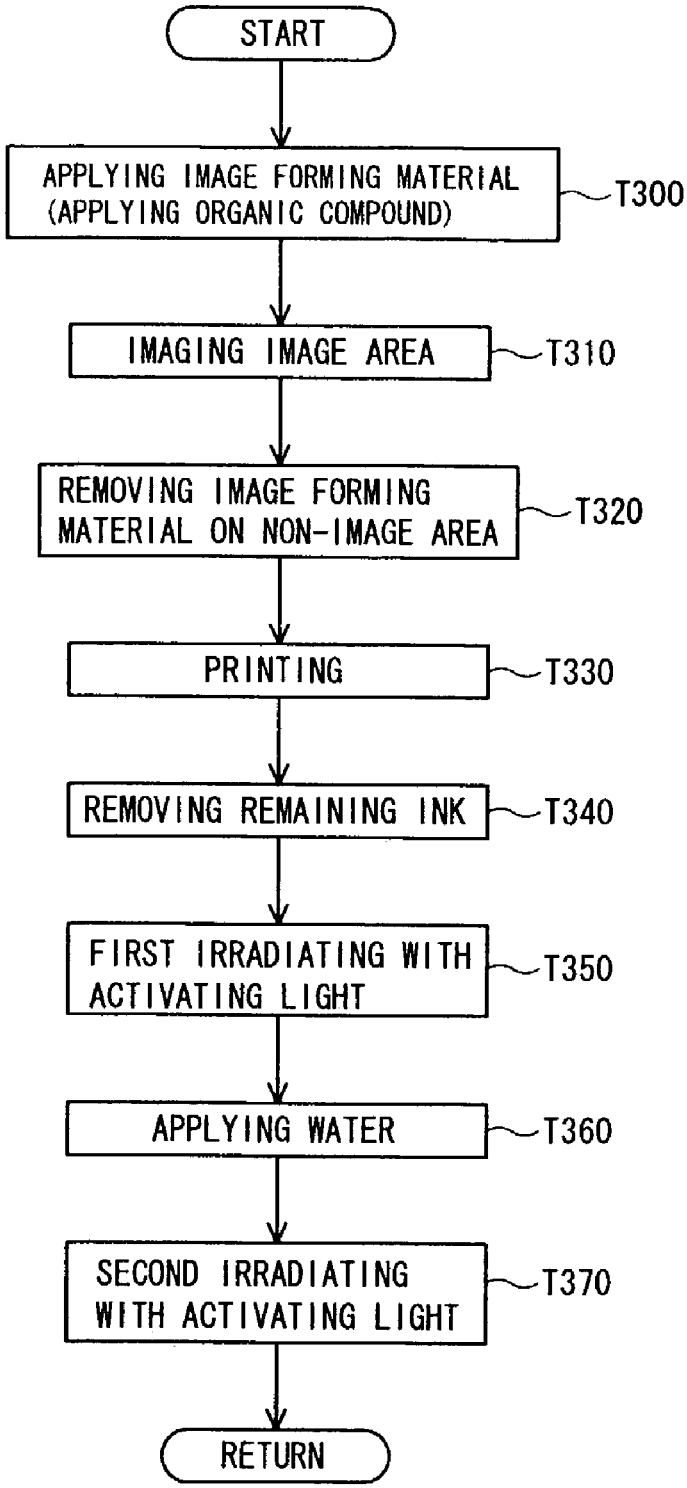
FIG. 21 is a flow diagram illustrating a succession of procedural steps of making and regenerating a printing plate according to the fourth embodiment.

Making and regenerating a printing plate comprises, as shown in FIG. 21, a succession of procedural steps of applying an image forming material onto the surface (applying the organic compound) (T300), forming an image (T310), removing the image forming material on anon-image area (T320), printing (T330), removing remaining ink (T340), first irradiating with activating light (T350), applying water (T360), and second irradiating with activating light (T370). Here, the steps (T350, T360 and T370) of first irradiating with activating light, applying water, and second irradiating with activating light are the steps to delete a formed image.

A succession of procedural steps of making a printing plate will now be described.

Hereinafter, "making of a printing plate" means to write a hydrophobic image area by irradiating, after applying the solution containing the organic compound (the image forming material) onto the surface, at least part of the surface of printing plate 35 on the basis of the digital data. After that, fine resin particles applied to a non-image area of printing plate 35, which areas have not been heated, are removed to expose hydrophilic photosensitive layer 3 so that a combination of the hydrophobic image area and the hydrophilic non-image area forms a latent image on printing plate 35.

Figure 20:
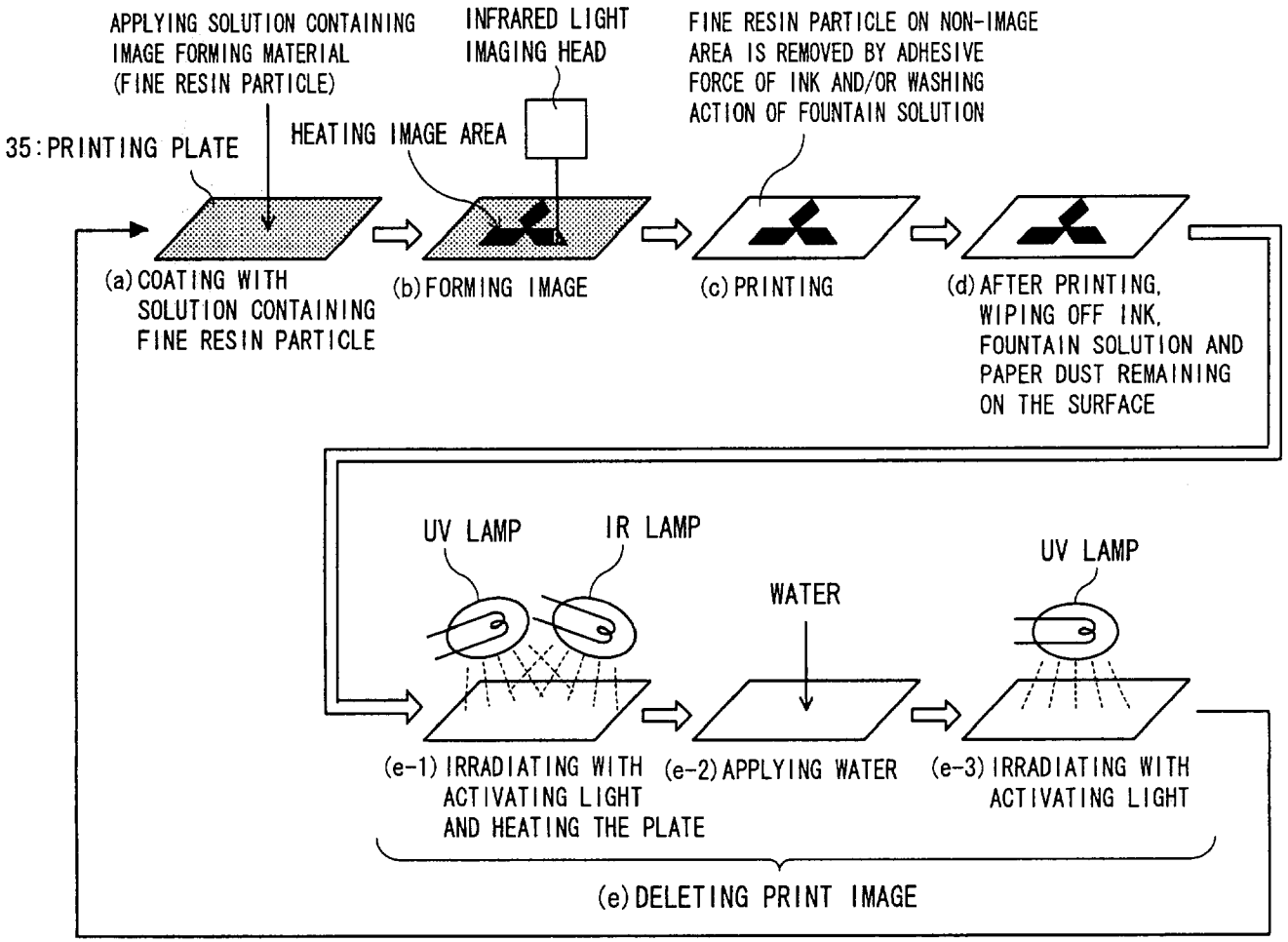
FIG. 20 is a perspective diagram illustrating a cycle of operations from image formation on the printing plate to regenerating the printing plate according to a fourth embodiment.

First of all, the solution containing the image forming material (fine resin particles), i.e., the organic compound of type B, is applied onto the surface of photosensitive layer 3, whose entire surface has been hydrophilized and then the applied solution is dried at room temperature, as shown in FIG. 20(*a*).

This state of the surface of photosensitive layer 3 will be called "the initial state in the making of the printing plate". More specifically, the initial state in the making of the printing plate can be considered as a state that the digital data representing a desired given image have already been provided and are about to be formed onto printing plate 35.

Subsequently, the desired image is formed onto the surface of photosensitive layer 3 in the step of forming a print image (T310), as shown in FIG. 20(*b*).

The forming of the print image is performed by writing an image area on one or more portions of the surface of photosensitive layer 3, which portions correspond to the digital data representing the desired image. An image area, as shown in FIG. 10, is hydrophobic and therefore has a contact angle of 50° or larger, preferably 80° or larger against water 6, which is in such a state that printing ink is easily held but the fountain solution is hardly deposited.

In order to write such a hydrophobic image area according to the digital data, the fine resin particle layer of the image area is preferably melted into a film form by heat and then reacted with and/or adhered on the surface of photosensitive layer 3. After the heating, fine resin particles on one or more portions which have not been heated are removed whereby a non-image area appears. That completes making of printing plate 35.

Heating of the fine resin particle layer is preferably performed by irradiation with light having energy lower than a band-gap energy of the photocatalyst. An example of "light having energy lower than the band-gap energy of the photocatalyst" is infrared light. Irradiation with such light melts the fine resin particles into a film form without decomposing the resin and also causes the film-form resin to react with and/or adhere to photosensitive layer 3.

In the illustrated example, at least part of the fine resin particles on photosensitive layer 3 are melted into a film form and then cause the film-form resin to react with and/or adhere to the surface of photosensitive layer 3 to form an image area by heat caused by irradiation with infrared light emitted from an infrared-light imaging head, as shown in FIG. 20(*b*)

After writing the image area, fine resin particles applied on the portions on which the image has not been written are removed from printing plate 35 by adhesive force of the ink and/or a washing action of the fountain solution, so that the non-image area appears, in the step (T320) of removing the image forming material on the non-image area shown in FIG. 20(*c*). This forms the image and non-image areas whereupon printing plate 35 becomes ready to perform printing in the subsequent step (T330) of printing.

In the illustrated example, light energy is utilized to heat one or more portions of the layer on which a solution containing the fine resin particles has been applied, which portions correspond to the digital image data, so that the image area is formed and appears. As an alternative, a thermal head directly heats the layer on which the solution containing the fine resin particles has been applied in order to form the image area.

After completion of removing the fine resin particles on the non-image area, a so-called emulsion ink of a mixture of a hydrophobic printing ink and the fountain solution is applied onto the surface of printing plate 35 in the step (T330) of printing shown in FIG. 20(*c*). This completes the making of printing plate 35 exemplified by FIG. 14.

The hatching portion in FIG. 14 represents layer 34 in a state in which fine resin particles have been melted into a film form by heat and subsequently have reacted with or stuck to the surface of photosensitive layer 3 including the photocatalyst, in other words, represents a state in which a hydrophobic printing ink adheres to the hydrophobic image area. Conversely, the remaining white portion (of the surface of photosensitive layer 3) represents a state in which the fountain solution preferentially adheres to, i.e., the hydrophilic non-image area 3*a*, which repels the hydrophobic ink so that the ink adheres to the non-image area. The resultant photosensitive layer 3 on which an image (a printing pattern) emerges functions as printing plate 35. After that, the image is printed on paper 20 to accomplish the step of printing.

A process of regenerating printing plate 35 will now be described.

Regeneration of the printing plate will hereinafter mean to cause printing plate 35, whose surface partially shows hydrophobicity with the remaining part showing hydrophilicity, to be restored to the initial state in the making of the printing plate by evenly hydrophilizing the entire surface of printing plate 35, by applying the solution containing the fine resin particles onto the surface in a hydrophilic state and by, if required, drying at room temperature.

A succession of procedural steps of regenerating a printing plate is started with the step (T340) of removing remaining ink in which ink, the fountain solution, paper dusts and the like remaining on photosensitive layer 3 and are wiped off after completion of printing, as shown in FIG. 20(*d*).

After that, in the step (T350) of first irradiating with the activating light shown in FIG. 20(*e*-1), the entire surface of photosensitive layer 3 part of the surface of which is in a hydrophobic state is irradiated with the activating light having energy higher than a band-gap energy of the photocatalyst. Irradiating the entire surface of photosensitive layer 3 with the activating light decomposes and removes thermoplastic resin layer 34 formed by the organic compound (the fine resin particles) have been melted.

In the illustrated example, irradiation with ultraviolet light emitted from a ultraviolet lamp decomposes the image area, as shown in FIG. 20(*e*-1).

Concurrently with the irradiation with ultraviolet light, the surface of photosensitive layer 3 may be heated to decompose and remove the thermoplastic resin layer 34 so that the image area is deleted in a shorter time.

Here, an ultraviolet (UV) lamp is used to irradiate the surface of photosensitive layer 3 with the activating light and an infrared (IR) lamp is used to heat the surface of photosensitive layer 3, as shown in FIG. 20(*e*-1).

A preferred manner to heat the surface of photosensitive layer 3 is performed by blowing hot air onto the surface or by irradiating the surface with light. Preferred irradiation light is infrared light, in consideration of heat efficiency.

For the same reason of the third embodiment, irradiating the surface of printing plate 35 with the activating light causes decomposition and removal of image area 34 formed (by the organic compound melted by heat) on the surface of printing plate 35 and at the same time causes hydrophilization of the surface of photosensitive layer 3 in the step (T350) of first irradiating with the activating light. The steps (T360, T370) of applying water and second irradiation with the activating light that are performed subsequent to the step (T350) of first irradiating with the activating light ensure complete and rapid hydrophilization of the surface of photosensitive layer 3.

After the organic compound is rapidly decomposed and removed by irradiating with the activating light within a heated atmosphere in the step (T350) of first irradiating with the activating light in the present embodiment, the surface of printing plate 35 is wet with water in the step (T360) of applying water, as shown in FIG. 20(*e*-2) and is irradiated with the activating light in the subsequent step (T370) of second irradiating with the activating light, as shown in FIG. 20(*e*-3), so that the surface of printing plate 35 is rapidly and completely hydrophilized. Thereby, the entire surface of photosensitive layer 3 becomes a hydrophilic state in which a contact angle is up to 10°, i.e., to be in the state shown in FIG. 11.

In the illustrated example described with reference to FIGS. 20 and 21, the step (T370) of second irradiating with the activating light takes place after the step (T360) of applying water. Alternatively, the steps (T360, T370) of applying water and second irradiation with the activating light may be performed in parallel. Namely, irradiation with the activating light may be carried out by applying water onto printing plate 35, whereupon hydrophilization of the surface of printing plate 35 is rapidly accomplished.

In the step (T360) of applying water, a hydrogen peroxide aqueous solution may be applied in substitute for water. Since the hydrogen peroxide aqueous solution enhances not only generation of a hydroxy group but also decomposition of the minute amount of the organic compound remaining on the surface of printing plate 35, the formed image can be completely deleted.

After completion of the steps (T350, T360 and T370) of first irradiating with the activating light, applying water and second irradiating with the activating light, the solution containing the fine resin particles is applied onto the entire surface of photosensitive layer 3, which is restored to hydrophilicity, at room temperature again and, if necessary, dried at room temperature to return photosensitive layer 3 into the initial state in the making of the printing plate 35.

The graph FIG. 15 illustrates all the steps described above. The abscissa represents the time passage (the procedural steps); and the ordinate, the contact angle printing plate 35 of water 6. The graph indicates the change of the contact angle of water 6 applied to the surface of printing plate 35 in accordance with the time passage or performance of the procedural steps. The one-dotted line in the graph represents the contact angle of water 6 on a non-image area; the thick broken lines (started at time points a and a'), that common to an image area and the non-image area; and the solid line, that on the image area 34.

The surface of photosensitive layer 3 is irradiated with ultraviolet light to show a high hydrophilicity in which the contact angle against water 6 is up to 10° in advance.

First of all, in the step (T300) of hydrophobizing the surface (Step A in FIG. 15), the solution containing the fine resin particles is applied onto the surface of photosensitive layer 3 (at time point (a) in FIG. 15) and, if necessary, the solution is dried at room temperature. The succession of procedural steps of FIG. 17 does not include a drying step. The completion of applying the solution containing the fine resin particle causes printing plate 35 to enter the initial state in making of the printing plate (time point (b) in FIG. 15).

In the subsequent step (T310) of formed image (step B in FIG. 15), heat treatment is performed on one or more portions on the surface of photosensitive layer 3 coated with fine resin particles, which portions correspond to the image area, to initiate writing an image area (at time point (b) in FIG. 15). The heating causes the fine resin particles to melt into a film form and to react with and/or adhere to the photosensitive layer 3 so that the image area exhibits high hydrophobicity. On the other hand, fine resin particles applied on the non-image area do not react with and/or adhere to the surface of photosensitive layer 3 and maintain an identical state to that before the step of forming the image.

Upon completion of writing the image area, a step of removing particles on the non-image area (step C in FIG. 15) starts to remove fine resin particles applied to the non-image area from the surface of photosensitive layer 3 by utilizing an adhesive force of the printing ink and a washing action of the fountain solution (time point (c) in FIG. 15). Namely, this removal exposes the hydrophilic portion of the surface of photosensitive layer 3 to form the non-image area. As a consequence, appearance of the hydrophobic image area formed by fine resin particles, after being melted into a film form, reacting with and/or adhering to the surface of photosensitive layer 3, and a hydrophilic non-image area from which fine resin particles have been removed make the surface of photosensitive layer 3 function as printing plate 35.

The completion of removing fine resin particles on the non-image area prompts the step (T330) of printing (step D in FIG. 15) (at time point (d) in FIG. 15).

After printing of the image, cleaning printing plate 35 is started by removing the printing ink (T340), dust and the like remaining on photosensitive layer 3 (at time point (e) in FIG. 15) to perform the step (T330) of removing remaining ink (step E in FIG. 15).

Upon completion of cleaning, i.e., removing remaining ink, the surface of photosensitive layer 3 is irradiated with the activating light and at the same time heated in the step (T350) of first irradiating with the activating light for the first step included in the step of deleting the formed image (step F in FIG. 15) so that image area 34 is rapidly decomposed and removed.

In the second step (T360) of applying water, water is applied onto the surface of printing plate 35, which is irradiated with the activating light in the subsequent third step (T370) of second irradiating with activating light. The surface of photosensitive layer 3 in a hydrophobic state rapidly changes to hydrophilic so that the entire surface of photosensitive layer 3 exhibits hydrophilicity again.

The step of deleting a formed image comprising the steps (T350, T360 and T370) of first irradiating with the activating light, applying water and second irradiating with the activating light can completely delete the image formed on the surface of printing plate 35.

After that, the solution containing the fine resin particles is applied again to the surface of photosensitive layer 3 in the step (T300) of applying the image forming material (Step A' in FIG. 15) (time point (a') in FIG. 15) to return to the initial state in the making of the printing plate for future reuse.

A method of making and regenerating of printing plate 35 will now be described with reference to FIG. 19. Plate cleaning unit 12 in contact with plate cylinder 11 wipes off ink, the fountain solution and paper dust remaining on the surface of printing plate 35. Plate cleaning unit 12 of FIG. 19 takes the form of a reeling cloth tape to wipe off ink, although plate cleaning unit 12 should be by no means limited to such a tape.

After wiping, plate cleaning unit 12 is disengaged from plate cylinder 11, and then the surface of printing plate 35 is heated by heating device 15 and irradiated with the activating light by hydrophilizing activating light irradiating unit 16 so that melted thermoplastic resin layer 34 formed on the surface of printing plate 35 is deleted.

Subsequently, after or while water feeder 21 applies water or a hydrogen peroxide aqueous solution onto the surface of printing plate 35, hydrophilizing activating light emitting unit 16 irradiates the surface of printing plate 35 with the activating light to hydrophilize the surface of printing plate 35.

In the illustrated example, the activated light emitted from hydrophilizing activating light emitting unit 16 is ultraviolet light whose wavelength is up to 400 nm. Alternatively, if a photocatalyst irradiated photosensitive layer 3 is activated by light having a wavelength of 400 nm to 600 nm, the activating light may be one having a wavelength of 400 nm to 600 nm.

Water or a hydrogen peroxide aqueous solution is applied onto the surface of printing plate 35 by a spray or a roller. Although the application manner should by no means be limited to these examples, another suitable manner can be selected and adopted.

After that, organic compound applier 14 applies the organic compound (of type B) onto the entire surface of printing plate 35 and then, for example, imaging unit 13 irradiates one or more portions to become an image area in accordance with the prepared digital image data with the activating light having energy lower than a band-gap energy of the photocatalyst included in photosensitive layer 3 to heat and melt the organic compound so that a hydrophobic image area is formed on the surface of photosensitive layer 3 (i.e., the desired image is written on the surface of printing plate 35).

After forming the image (here, writing the image area), inking roller 17, fountain solution feeder 16, and blanket cylinder 19 are moved so as to be in contact with plate cylinder 11, and paper 20 is disposed so as to be in contact with blanket cylinder 19. Plate cylinder 11 and blanket cylinder 19 respectively rotate in the directions indicated by respective arrows, whereby the fountain solution and ink are subsequently applied onto printing plate 35, and the formed image is printed on paper 20.

A succession of procedural steps for regenerating printing plate 35 can be performed by printing press 10 because printing press 10, in order to serve as an apparatus for regenerating printing plate 35, comprises plate cleaning unit 12 to clean the surface of printing plate 35 mounted on plate cylinder 11, hydrophilizing activating light emitting unit 16 to decompose and remove an image area and hydrophilize the surface of printing plate 35 by irradiation with the activating light, fountain solution feeder 18 to apply the fountain solution onto the surface of printing plate 35, and organic compound applier 14 to apply the organic compound of type B onto the surface of printing plate 35. Additionally included imaging unit 13 to form an image on printing plate 35 allows printing press 10 to execute the succession of procedural steps of making and regenerating a printing plate with printing plate 35 continuing to be mounted on plate cylinder 11. With this configuration, it is possible to continue printing operation without stopping printing press 10 or changing printing plate 35.

Additionally, heating device 15 may be included in printing press 10 as a configuration element to heat the surface of printing plate 35 in order to decompose and remove of melted thermoplastic resin layer 34.

Printing press 10 of the illustrated example includes printing plate 35 mounted around plate cylinder 11, although printing plate 35 should by no means be limited to this. Alternatively, photosensitive layer 3 may be directly formed on plate cylinder 11, that is, plate cylinder 11 and printing plate 35 are joined together into an integrated form.

Alternatively, if the fountain solution substitutes water or hydrogen peroxide applied to enhance the hydrophilization of the surface of the printing plate 35, fountain solution feeder 18 may apply the fountain solution in step (T360 (T350 in the third embodiment)) of applying water.

Imaging unit 13 emits inactivating light to write an image area in the present embodiment, although imaging unit 13 of the third embodiment emits activating light to form a non-image area.

As described above, the printing press, the apparatus and the processes for regenerating a printing plate with which printing has been accomplished according to the third and the fourth embodiments have an advantage of a faster regenerating processes caused by high-speed decomposition and removal of a hydrophobic image area and of absorbed organic substances, such as the remaining ink resin and by high-speed hydrophilization of the surface of printing plate 35 after the ink cleaning step.

Further, complete deletion of a formed image minimizes deterioration of and impurity accumulation on the printing plate to increase the number of times that the same printing plate can be used.

Realization of regeneration and reuse of a printing plate greatly reduces wastes discarded after completion of a succession of printing processes, also reducing printing plate costs.

Further, the present invention should by no means be limited to these foregoing embodiments, and various changes or modifications may be suggested without departing from the gist of the invention.

What is claimed is (US):

1. A process for regenerating, for future reuse, a printing plate including a photosensitive layer, formed on the surface of a substrate and having a photocatalyst that exhibits hydrophilicity responsive to activating light having energy higher than a band-gap energy of the photocatalyst, and one or more hydrophobic image areas, formed on the surface of the photosensitive layer and operable to hold ink, said process comprising the steps of:

(a) removing ink remaining on the surface of the printing plate;

(b) irradiating the surface of the printing plate, from which ink has been removed in said step (a) of removing ink, with the activating light;

after said step (b) of irradiating, (c) applying water onto the surface of the printing plate;

(d) irradiating the surface of the printing plate, to which the water has been applied, with the activating light; and after said step (d) of irradiating, (e) applying an organic compound onto the surface of the printing plate.

2. A process for regenerating a printing plate according to claim 1, wherein said step (d) of irradiating is performed after said step (c) of applying water.

3. A process for regenerating a printing plate according to claim 1, wherein said step (d) of irradiating and said step (c) of applying water are performed in parallel.

4. A process for regenerating a printing plate according to claim 1, wherein the surface of the printing plate is heated in said step (d) of irradiating.

5. A process for regenerating a printing plate according to claim 4, wherein the surface of the printing plate is heated to approximately 50° C. to 200° C.

6. A process for regenerating a printing plate according to claim 4, wherein the heating of the surface of the printing plate is performed by blowing hot air.

7. A process for regenerating a printing plate according to claim 4, wherein the heating of the surface of the printing plate is performed by irradiating the surface of the printing plate with light.

8. A process for regenerating a printing plate according to claim 1, wherein the activating light has a wavelength of 600 nm or shorter.

9. A process for regenerating a printing plate according to claim 1, wherein the photocatalyst is one from a titanium dioxide photocatalyst and a modified titanium dioxide photocatalyst.

10. A process for regenerating a printing plate according to claim 1, wherein the organic compound has a property of decomposing under action of the photocatalyst caused by irradiation with the activating light and a property of hydrophobizing the surface of the printing plate by reacting and/or interacting with the surface of the printing plate.

11. A process for regenerating a printing plate according to claim 1, wherein the organic compound has a property of decomposing under action of the photocatalyst caused by irradiation with the activating light and a property of hydrophobizing the surface of the printing plate, after the organic compound is melted into a film form by heat, by reacting and/or interacting with the surface of the printing plate or by adhering to the surface of the printing plate.

12. A process for regenerating, for future reuse, a printing plate including a photosensitive layer, formed on the surface of a substrate and having a photocatalyst that exhibits hydrophilicity responsive to activating light having energy higher than a band-gap energy of the photocatalyst, and one or more hydrophobic formed on the surface of the photosensitive layer and operable to hold ink, said process comprising the steps of:

(a) removing ink remaining on the surface of the printing plate;

(b) irradiating the surface of the printing plate, from which ink has been removed in said step (a) of removing ink, with activating light;

after said step (b) of irradiating, (c) applying a hydrogen peroxide aqueous solution onto the surface of the printing plate; and (d) irradiating the surface of the printing plate, to which the water has been applied, with the activating light.

13. An apparatus for regenerating, for future reuse, a printing plate including a photosensitive layer, formed on the surface of a substrate and having a photocatalyst that exhibits hydrophilicity responsive to activating light having energy higher than a band-gap energy of the photocatalyst, and one or more hydrophobic image areas, formed on the surface of the photosensitive layer and operable to hold ink, said apparatus comprising:

a plate cleaning unit for removing remaining ink coating the surface of the printing plate;

an activating light emitting unit for emitting the activating light for irradiating the surface of the printing plate; and a feeder for applying a hydrogen peroxide aqueous solution onto the surface of the printing plate when an image formed thereon is deleted, said plate cleaning unit, said activating light emitting unit, and said water feeder being disposed around a plate cylinder on which the printing plate is to be mounted, respectively.

* * * * *